US012098876B2

(12) United States Patent
Yoon et al.

(10) Patent No.: US 12,098,876 B2
(45) Date of Patent: Sep. 24, 2024

(54) REFRIGERATOR AND CONTROL METHOD THEREOF

(71) Applicant: SAMSUNG ELECTRONICS CO., LTD., Suwon-si (KR)

(72) Inventors: Wonjae Yoon, Suwon-si (KR); Kookjeong Seo, Suwon-si (KR); Sucheol Yoo, Suwon-si (KR); Kyunghoon Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 358 days.

(21) Appl. No.: 17/570,108

(22) Filed: Jan. 6, 2022

(65) Prior Publication Data

US 2022/0205698 A1 Jun. 30, 2022

Related U.S. Application Data

(63) Continuation of application No. PCT/KR2021/019423, filed on Dec. 20, 2021.

(30) Foreign Application Priority Data

Dec. 28, 2020 (KR) ..... 10-2020-0185191

(51) Int. Cl.
*F25D 11/02* (2006.01)
*F25B 19/00* (2006.01)
(Continued)

(52) U.S. Cl.
CPC ..... *F25D 11/022* (2013.01); *F25D 17/065* (2013.01); *F25D 19/00* (2013.01); *F25D 2700/12* (2013.01); *F25D 2700/14* (2013.01)

(58) Field of Classification Search
CPC ..... F25D 11/022; F25D 17/065; F25D 19/00; F25D 2700/12; F25D 2700/14; F25B 5/02;
(Continued)

(56) References Cited

U.S. PATENT DOCUMENTS 7,810,340 B2 10/2010 Owada et al.
10,465,967 B2 11/2019 Besore et al.
(Continued)

FOREIGN PATENT DOCUMENTS

JP 2001-263902 A 9/2001
KR 10-1999-0016786 A 3/1999
(Continued)

OTHER PUBLICATIONS

International Search Report dated Apr. 11, 2022 issued in Application No. PCT/KR2021/019423.

*Primary Examiner* — Marc E Norman
(74) *Attorney, Agent, or Firm* — STAAS & HALSEY LLP

(57) ABSTRACT

A refrigerator including a main body having a storage chamber and a cold air supply device configured to supply cold air to the storage chamber, wherein the cold air supply device includes a compressor, a condenser configured to condense a refrigerant compressed by the compressor, a flow path switching valve connected to the condenser, a first capillary tube and a second capillary tube connected to the flow path switching valve, respectively, the second capillary tube arranged in parallel with the first capillary tube, and a cluster pipe arranged between the flow path switching valve and the first capillary tube to further condensate the refrigerant pass therethrough. The flow path switching valve is
(Continued)

configured to selectively allow the refrigerant received from the condenser to flow into the first capillary tube or the second capillary tube.

18 Claims, 13 Drawing Sheets

(51) Int. Cl.
*F25D 17/06* (2006.01)
*F25D 19/00* (2006.01)

(58) Field of Classification Search
CPC .. F25B 5/04; F25B 41/20; F25B 41/37; F25B 41/385; F25B 2341/062; F25B 2600/2511
See application file for complete search history.

(56) References Cited

U.S. PATENT DOCUMENTS

2007/0039339 A1* 2/2007 Lee ..... F25D 21/14 62/158
2007/0068180 A1* 3/2007 Yoon ..... F25D 11/022 62/200
2011/0146303 A1 6/2011 Seo et al.
2011/0146310 A1 6/2011 Kim et al.

FOREIGN PATENT DOCUMENTS

| | | | |
|---|---|---|---|
| KR | 1999-0042209 | | 6/1999 |
| KR | 10-2008-0005244 | | 1/2008 |
| KR | 10-0808180 | B1 | 2/2008 |
| KR | 10-2010-0034080 | A | 4/2010 |
| KR | 10-2011-0072251 | | 6/2011 |
| KR | 10-2011-0072441 | | 6/2011 |
| KR | 10-2014-0047355 | A | 4/2014 |
| KR | 10-2014-0144016 | | 12/2014 |
| KR | 10-2014-0144024 | A | 12/2014 |
| KR | 10-2126401 | B1 | 6/2020 |
| KR | 10-2020-0106468 | A | 9/2020 |

* cited by examiner

REFRIGERATOR AND CONTROL METHOD THEREOF

CROSS-REFERENCE TO RELATED APPLICATIONS

This application is a continuation application, under 35 U.S.C. § 111(a), of International Patent Application No. PCT/KR2021/019423, filed on Dec. 20, 2021, which claims the priority benefit of Korean Patent Application No. 10-2020-0185191, filed on Dec. 28, 2020 in the Korean Patent and Trademark Office, the disclosures of which are hereby incorporated by reference in their entirety.

BACKGROUND

1. Field

The disclosure relates to a refrigerator having an improved cold air supply device and a method of controlling the same.

2. Description of Related Art

In general, a refrigerator adopts a refrigeration cycle in which a refrigerant circulates therein to keep food fresh for a long time by supplying cold air generated by absorbing surrounding heat when a liquid refrigerant vaporizes to a food storage chamber. Among such food storage chambers, a freezing chamber is maintained at a temperature of approximately minus 20 degrees Celsius, and a refrigerating chamber is maintained at a low temperature of approximately minus 3 degrees Celsius.

The refrigerant circulating in the refrigerator in the refrigeration cycle may be cooled to a varying degree depending on the ambient temperature. For example, when the ambient temperature is low, the refrigerant is super-cooled and a large amount of refrigerant is collected in the condenser so that the evaporator side is short of refrigerant.

Therefore, in the conventional technology, the refrigerant shortage is eased by increasing the rotational speed of the compressor to increase the pressure inside the refrigeration cycle, but such a method does not only increase the noise of the refrigerator but also increases the overall power consumption.

SUMMARY

One aspect of the disclosure provides a refrigerator for preventing super-cooling of a refrigerant when the ambient temperature of the refrigerator is low, and a method of controlling the same.

Another aspect of the disclosure provides a refrigerator in which power consumption is improved while preventing a refrigerant shortage that occurs when the ambient temperature of the refrigerator is low, and a method of controlling the same.

According to an aspect of the present disclosure, there is provided a refrigerator including: a main body having a storage chamber; and a cold air supply device configured to supply cold air to the storage chamber, wherein the cold air supply device includes: a compressor; a condenser configured to condense a refrigerant compressed by the compressor;

a flow path switching valve connected to the condenser; a first capillary tube and a second capillary tube connected to the flow path switching valve, respectively, the second capillary tube arranged in parallel with the first capillary tube; a cluster pipe arranged between the flow path switching valve and the first capillary tube to further condensate the refrigerant pass therethrough. The flow path switching valve may be configured to selectively allow the refrigerant received from the condenser to flow into the first capillary tube or the second capillary tube.

The refrigerator may further include: a temperature sensor configured to detect an external temperature which is an indoor temperature outside the refrigerator; and a controller configured to control the cold air supply device based on the external temperature detected by the temperature sensor so that the controller controls the flow path switching valve to selectively allow the refrigerant received from the condenser to flow to the first capillary tube or the second capillary tube.

When the controller determines that the external temperature is higher than or equal to a set temperature, the controller may control the cold air supply device to operate in a high temperature mode in which the refrigerant received from the condenser flows through the cluster pipe and the first capillary tube, and when the controller determines that the external temperature is lower than the set temperature, the controller may control the cold air supply device to operate in a low temperature mode in which the refrigerant received from the condenser bypasses the cluster pipe and the first capillary tube, and flows through the second capillary tube.

The cold air supply device may further include a heat dissipation fan configured to increase a heat dissipation efficiency of the condenser, and wherein the controller, in the low temperature mode, may control the heat dissipation fan to be driven at a revolutions per minute (RPM) lower than a RPM in the high temperature mode.

The cold air supply device may further include an evaporator connected to the first capillary tube and to the second capillary tube to evaporate the refrigerant received from the first capillary tube or the second capillary tube.

The storage chamber may include a refrigerating chamber and a freezing chamber, and the evaporator may include: a first evaporator disposed in the refrigerating chamber; and a second evaporator disposed in the freezing chamber.

A refrigerator may comprises a main body having a storage chamber and a cold air supply device configured to supply cold air to the storage chamber. The cold air supply device comprises a compressor, a condenser configured to condense a refrigerant compressed by the compressor, a first flow path switching valve connected to the condenser, a second flow path switching valve connected to the first flow path switching valve, a cluster pipe arranged between the first flow path switching valve and the second flow path switching to further condensate the refrigerant pass therethrough, a first capillary tube and a third capillary tube connected to the second flow path switching valve, respectively, the third capillary tube arranged in parallel with the first capillary tube, and a second capillary tube connected to the first flow path switching valve and in parallel with the cluster pipe.

The first flow path switching valve may be configured to selectively allow the refrigerant received from the condenser to flow into the second capillary tube or the cluster pipe, and the second flow path switching valve is configured to selectively allow the refrigerant received from the cluster pipe to flow into the first capillary tube or the third capillary tube The cold air supply device may further comprise a first evaporator connected to the first capillary tube to evaporate the refrigerant received from the first capillary tube and a second evaporator connected to the third capillary tube to evaporate the refrigerant received from the third capillary tube.

The cold air supply device may further include a fourth capillary tube connected to the first flow path switching valve and in parallel with the second capillary tube and the cluster pipe so that the refrigerant received from the condenser is selectively flows into the second capillary tube, the cluster pipe or the fourth capillary tube, and the second capillary tube may be connected to the first evaporator, and the fourth capillary tube is connected to the second evaporator.

The refrigerator may further include: a temperature sensor configured to detect an external temperature which is an indoor temperature outside the refrigerator; and a controller configured to control the first flow path switching valve and the second flow path switching valve based on the external temperature detected by the temperature sensor to selectively allow the refrigerant received from the condenser to flow into the first capillary tube, the second capillary tube, third capillary tube, or the fourth capillary tube.

When the controller determines that the detected external temperature is higher than or equal to a first high set temperature, the controller may control the cold air supply device to operate in a first high temperature mode in which the refrigerant flows through the cluster pipe and then flows through the first capillary tube and the first evaporator, and when the controller determines that the detected external temperature is higher than or equal to a second high set temperature, the controller may control the cold air supply device to operate in a second high temperature mode in which the refrigerant passes through the cluster pipe and then flows through the third capillary tube and the second evaporator.

When the controller determines that the detected external temperature is lower than a first low set temperature, the controller may control the cold air supply device to operate in a first low temperature mode in which the refrigerant bypasses the cluster pipe and flows through the second capillary tube and the first evaporator, and when the controller determines that the detected external temperature is lower than a second low set temperature, may control the cold air supply device to operate in a second low temperature mode in which the refrigerant bypasses the cluster pipe and flows through the fourth capillary tube and the second evaporator.

The first evaporator and the second evaporator may be connected in series to each other such that cooling of the refrigerating chamber is selectively performed.

The first evaporator and the second evaporator may be connected in parallel with each other such that cooling of the freezing chamber and cooling of the refrigerating chamber are independently performed.

The second capillary tube may have a length longer than a length of the first capillary tube.

The refrigerator may further include a hot pipe arranged between the condenser and the flow path switching valve.

The storage chamber may include a refrigerating chamber and a freezing chamber, and the first evaporator disposed in the refrigerating chamber and the second evaporator disposed in the freezing chamber.

A method of controlling a refrigerator having a condenser, a flow path switching valve connected to the condenser, a first capillary tube and a second capillary tube connected to the flow path switching valve, respectively, a temperature sensor, a controller and a cluster pipe disposed between the flow path switching value and the first capillary tube, the method includes detecting whether an external temperature which is an indoor temperature outside the refrigerator by a temperature sensor of the refrigerator, determining whether the detected external temperature is higher than or equal to a set temperature, in response to determining that the detected external air is higher than or equal to the set temperature, performing a high temperature mode including, controlling, by a controller, to control the flow path switching valve to allow the refrigerant received from the condenser to pass through the cluster pipe and the first capillary tube while bypassing the second capillary tube; and in response to determining the detected external air is lower than the set temperature, performing a low temperature mode including, controlling, by the controller, to control the flow path switching valve to allow the refrigerant received from the condenser to pass through the second capillary tube while bypassing the cluster pipe and the first capillary tube.

According to another aspect of the present disclosure, there is provided a method of controlling a refrigerator having a cold air supply device including a compressor, a condenser, a flow path switching valve connected at an outlet side of the condenser, first and second capillary tubs connected in parallel with each other at an outlet side of the flow path switching valve, and a cluster pipe disposed between the flow path switching value and the first capillary tube, the method including: identifying whether an external air is higher than or equal to a set temperature through a temperature sensor; and when it is identified that the external air is higher than or equal to the set temperature; performing a high temperature mode in which a refrigerant passes through the cluster pipe and the first capillary tube; and when the external air is lower than the set temperature, performing a low temperature mode in which the refrigerant bypasses the cluster pipe and passes through the second capillary tube.

The cold air supply device further includes a heat dissipation fan configured to increase a heat dissipation efficiency of the condenser, and the method includes, in the low temperature mode, controlling the heat dissipation fan to be driven at a revolutions per minute (RPM) lower than a RPM in the high temperature mode.

The flow path switching valve may be a first flow path switching valve, and the cold air supply device may further include: a third capillary tube connected in parallel with the first capillary tube; and a second flow path switching valve disposed between the cluster pipe and a branch point between the first capillary tube and the third capillary tube.

According to another aspect of the present disclosure, there is provided a refrigerator including a main body having a storage chamber, a cold air supply device for supplying cold air to the storage chamber, a temperature sensor for detecting an external air temperature, and a controller configured to control the cold air supply device based on the external air temperature detected by the temperature sensor, wherein the cold air supply device includes a compressor, a condenser configured to condense a refrigerant compressed in the compressor, a first capillary tube connected at an outlet side of the condenser, and a second capillary tube connected in parallel with the first capillary tube, a flow path switching valve provided such that the refrigerant passing through the condenser flows into the first capillary tube or the second capillary tube, and a cluster pipe disposed between the flow path switching valve and the first capillary tube to assist in condensation of the refrigerant, wherein the controller is configured to control the cold air supply device to operate in a high-temperature mode in which the refrigerant flows through the cluster pipe and the first capillary tube when the external air temperature is higher than or equal to a set temperature.

The cold air supply device may further include a heat dissipation fan configured to increase a heat dissipation efficiency of the condenser, and wherein the controller, when the external air is less than the set temperature, may control the cold air supply device to operate in a low temperature mode in which the refrigerant bypasses the cluster pipe, and control the heat dissipation fan to be driven at a revolutions per minute (RPM) lower than a RPM in the high temperature mode.

As is apparent from the above, the structure of a cold air supply device is improved such that a refrigerant is prevented from being super-cooled when the ambient temperature is low.

The flow of the refrigerant is allowed to vary based on the ambient temperature, so that power consumption can be improved by keeping the cooling efficiency constant regardless of the environment.

DETAILED DESCRIPTION

Figure 1:
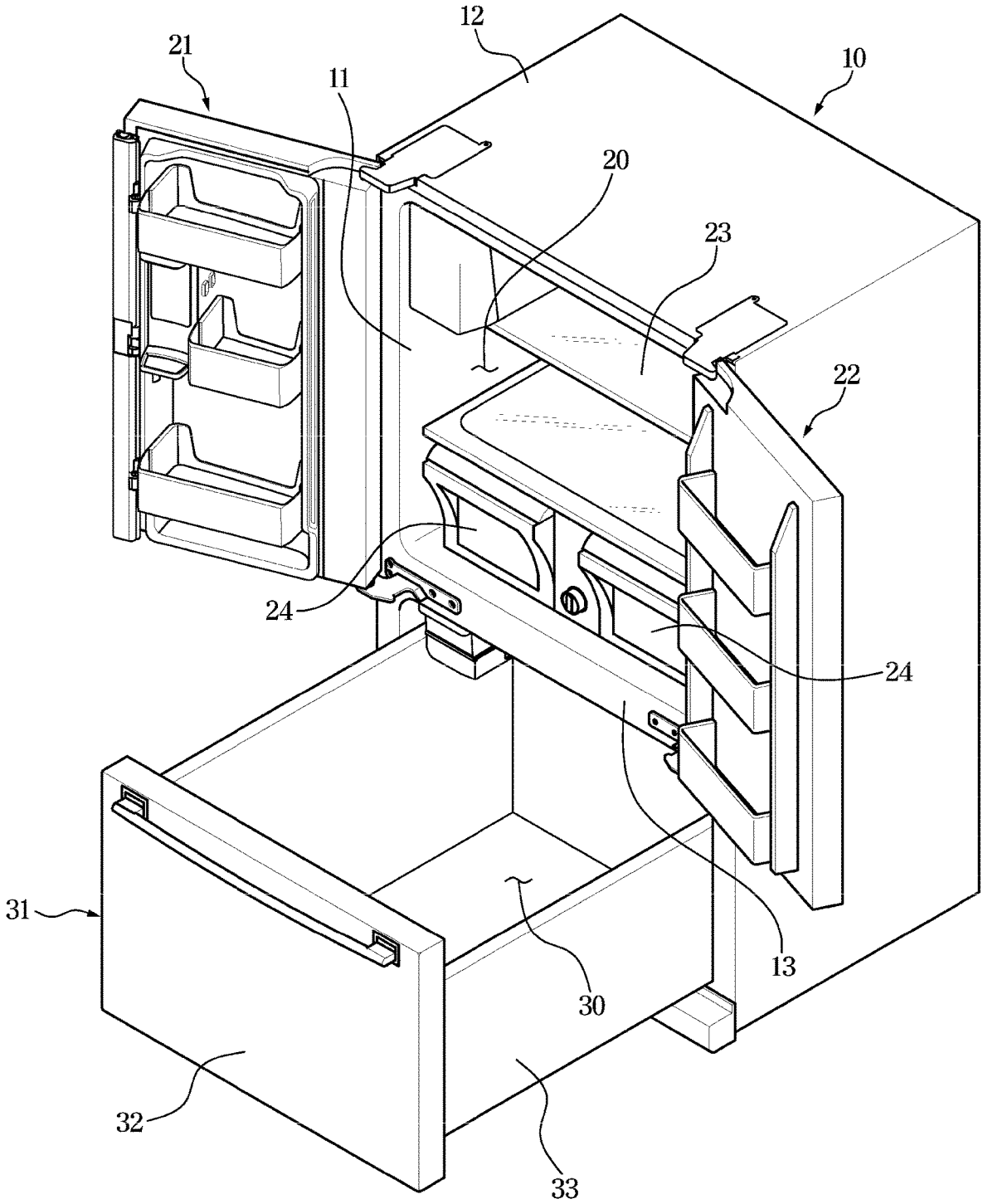
FIG. 1 is a perspective view illustrating a refrigerator according to an embodiment of the disclosure.

The embodiments set forth herein and illustrated in the configuration of the disclosure are only the most preferred embodiments and are not representative of the full technical spirit of the disclosure, so it should be understood that they may be replaced with various equivalents and modifications at the time of the disclosure.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

Hereinafter, embodiments according to the disclosure will be described in detail with reference to the accompanying drawings.

FIG. 1 is a perspective view illustrating a refrigerator according to an embodiment of the disclosure.

Referring to FIG. 1, a refrigerator 1 according to an embodiment of the disclosure may include a main body 10, storage chambers 20 and 30 formed inside the main body 10, and doors 21, 22, and 31 configured to open and close the storage chambers 20 and 30.

The main body 10 may include an inner case 11 forming the storage chambers 20 and 30, an outer case 12 coupled to the outside of the inner case 11, and an insulator (not shown) provided between the inner case 11 and the outer case 12.

The inner case 11 may be formed by injection of a plastic material, and the outer case 12 may be formed of a metal material. A urethane foam insulator may be used as the insulator, and may be used together with a vacuum insulator as needed.

The urethane foam insulator may be formed by coupling the inner case 11 and the outer case 12 to each other, filling a foam urethane having a mixture of urethane and a foaming agent between the inner case 11 and the outer case 12, and foaming the foam urethane. The foam urethane may have a strong adhesive force that strengthens the bonding force between the inner case 11 and the outer case 12, and when foaming is completed, have a sufficient strength.

The main body 10 may include an intermediate wall 13 that divides the storage chambers 20 and 30 in an upper-lower direction. The intermediate wall 13 may divide the refrigerating chamber 20 and the freezing chamber 30 from each other.

Meanwhile, the dividing of the storage chambers 20 and 30 is not limited to that shown in FIG. 1, and may be implemented in various known forms.

The storage chambers 20 and 30 may include a refrigerating chamber 20 formed at an upper side of the main body 10 and a freezing chamber 30 formed at a lower side of the main body 10. That is, the freezing chamber 30 may be provided below the refrigerating chamber 20.

The refrigerating chamber 20 is maintained at approximately 0 to 5 degrees Celsius to keep foods refrigerated. The freezing chamber 30 is maintained at approximately minus 30 to 0 degrees Celsius to keep foods frozen.

The refrigerating chamber 20 may be provided with a shelf 23 on which food is placed and a storage container 24 in which food is stored.

The refrigerating chamber 20 and the freezing chamber 30 may each have an open front through which food is inserted and withdrawn. The open front of the refrigerating chamber 20 may be opened and closed by a pair of refrigerating chamber doors 21 and 22 coupled to the main body 10. The refrigerator chamber doors 21 and 22 may be rotatably coupled to the main body 10. The open front of the freezing chamber 30 may be opened and closed by a freezing chamber door 31 slidable with respect to the main body 10. The freezing chamber door 31 may be provided in the shape of a box with an open top, and may include a front panel 32 forming the external appearance and a drawer 33 coupled to a rear side of the front panel 32.

However, the shape of the freezing chamber door 31 is not limited thereto, and may be provided in a form rotatably coupled to the main body 10 similar to that of the refrigerating chamber doors 21 and 22.

A gasket (not shown) may be provided on edge portions of rear surfaces of the refrigerating chamber doors 21 and 22 to seal between the refrigerating chamber doors 21 and 22 and the main body 10 when the refrigerating chamber doors 21 and 22 are closed to control the cold air in the refrigerating chamber 20.

In addition, the refrigerator 1 may include a cold air supply device 100 for supplying cold air to the storage chamber. Details of the cold air supply device 100 will be described below.

In addition, the form of the refrigerator 1 is not limited thereto, and the refrigerator may be provided in various types, such as a top-mounted freezer (TMF) type refrigerator in which a freezing chamber is formed at the upper side of the main body 10 and a refrigerating chamber is formed at the lower side of the main body 10, or a side by side (SBS) type refrigerator.

Moreover, the refrigerator 1 may be provided in any other form as long as it can be supplied with cold air by the cold air supply device 100.

Figure 2:
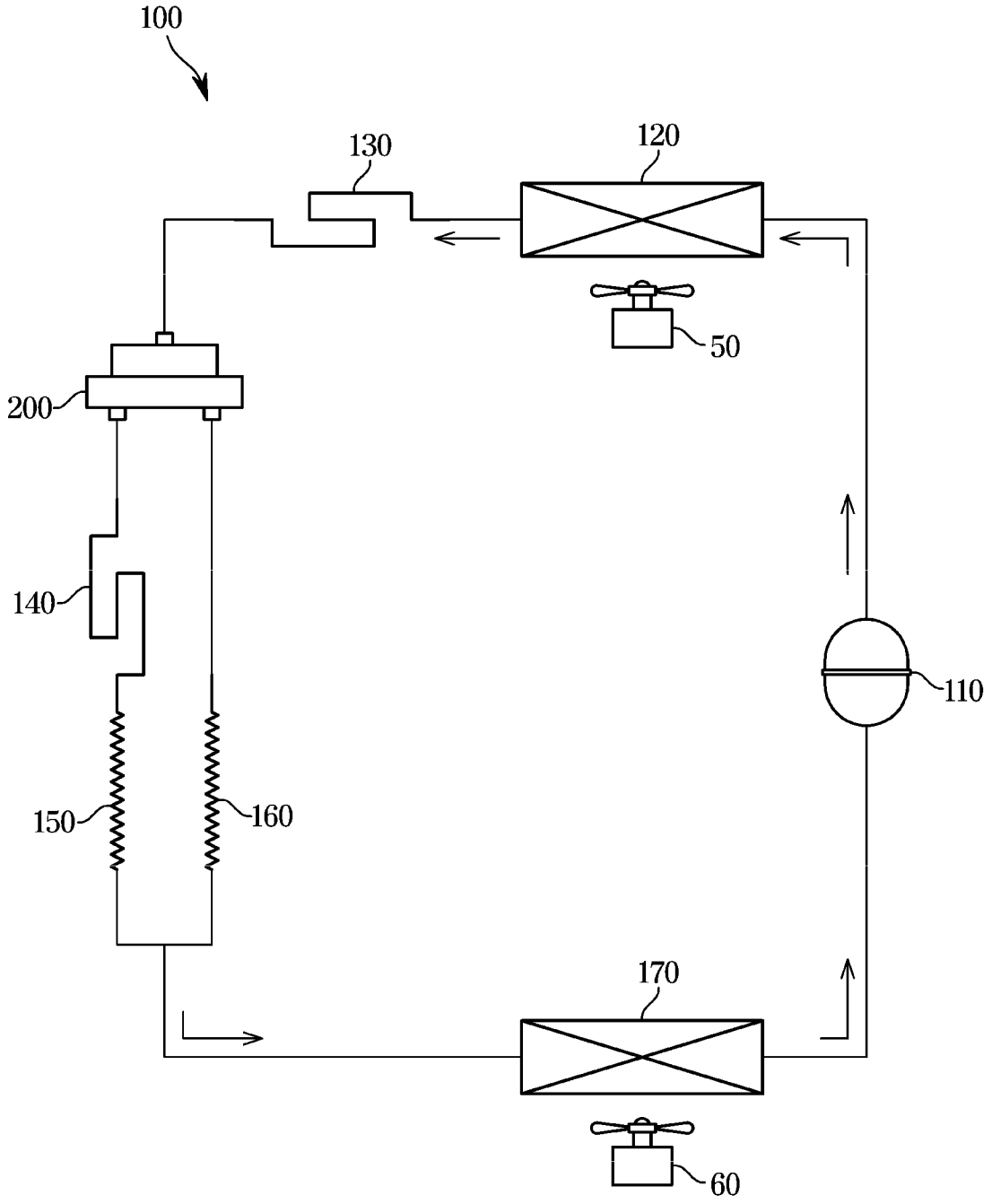
FIG. 2 is a circuit diagram illustrating a cold air supply device of the refrigerator according to an embodiment of the disclosure.

FIG. 2 is a circuit diagram illustrating a cold air supply device of the refrigerator according to an embodiment of the disclosure.

The cold air supply device 100 may include a compressor 110 and a condenser 120.

The compressor 110 may be provided to compress a refrigerant that is provided to circulate through the cold air supply device 100 into a high-temperature and high-pressure gas.

The condenser 120 may be provided to condense the refrigerant compressed in the compressor 110. Specifically, the condenser 120 may be provided to radiate heat of the high-temperature and high-pressure gas refrigerant compressed in the compressor 110 such that the high-temperature and high-pressure gas refrigerant is phase-changed into a liquid at a room temperature.

The cold air supply device 100 may include a hot pipe 130. The hot pipe 130 may be installed at a circumference of the main body 10 of the refrigerator 1 to prevent water vapor from condensing on a portion in which the door and the main body 10 come in contact with each other. The hot pipe 130 may be disposed between the condenser 120 and a flow path switching valve 200.

The working refrigerant flowing through the cold air supply device 100 may include HC-based isobutane (R600a), propane (R290), HFC-based R134a, and HFO-based R1234yf. However, the type of the refrigerant is not limited, and the refrigerant may be provided in any other type as long as it can reach a target temperature through heat exchange with the surroundings.

The cold air supply device 100 may include a flow path switching valve 200, a first capillary tube 150, and a second capillary tube 160. In addition, the cold air supply device 100 may include a cluster pipe 140.

The first capillary tube 150 may be connected at the outlet side of the condenser 120. The second capillary tube 160 may be connected at the outlet side of the condenser 120. More specifically, the second capillary tube 160 may be connected in parallel with the first capillary tube 150. In this case, the connection at the outlet side of the condenser 120 refers to being provided at a downstream side of the condenser 120 with respect to the flow direction of the refrigerant.

The first capillary tube 150 and the second capillary tube 160 may have different tube diameters and lengths. More specifically, the second capillary tube 160 may have a length longer than that of the first capillary tube 150.

The refrigerant may expand while flowing through the first capillary tube 150 or the second capillary tube 160, and thus be lowered in the pressure.

The refrigerant may selectively flow into the first capillary tube 150 or the second capillary tube 160 according to the operation of a high-temperature mode or a low-temperature mode, which will be described below. Details thereof will be described below.

The flow path switching valve 200 may be connected at the outlet side of the condenser 120. The first capillary tube 150 and the second capillary tube 160 may be connected in parallel with each other at the outlet side of the flow path switching valve 200.

The flow path switching valve 200 may be provided such that the refrigerant having passed through the condenser 120 flows into the first capillary tube 150 or the second capillary tube 160. That is, the refrigerant may selectively flow into the first capillary tube 150 or the second capillary tube 160 according to control of the flow path switching valve 200.

The cluster pipe 140 may be provided to assist in the condensation of the refrigerant. More specifically, the cluster pipe 140 may be provided to additionally radiate a high-temperature refrigerant to serve as an auxiliary condenser 120.

The cluster pipe 140 may be disposed between the flow path switching valve 200 and the first capillary tube 150. With such a configuration, the refrigerant may pass through the cluster pipe 140 only when the flow path switching valve 200 is controlled to be opened toward the first capillary tube 150. In other words, when the flow path switching valve 200 is controlled to be opened toward the second capillary tube 160, the refrigerant may not pass through the cluster pipe 140. Details thereof will be described below.

The cold air supply device 100 may include an evaporator 170. The evaporator 170 may be provided to be connected at the outlet side of the first capillary tube 150 and the second capillary tube 160 connected in parallel with each other. The evaporator 170 is provided to allow the refrigerant, which has been expanded in the first capillary tube 150 or the second capillary tube 160 into a low-pressure liquid state, to be phase-changed into a gas to absorb surrounding heat. In other words, the evaporator 170 may be provided to evaporate the refrigerant.

The cold air supply device 100 may include a heat dissipation fan 50 and a blowing fan 60.

The heat dissipation fan 50 may be provided adjacent to the condenser 120. The blowing fan 60 may be provided adjacent to the evaporator 170. The heat dissipation fan 50 may be provided to increase the heat dissipation efficiency of the condenser 120. The blowing fan 60 may be provided to increase the evaporation efficiency of the evaporator 170.

The compressor 110, the condenser 120, the hot pipe 130, the flow path switching valve 200, the first capillary tube 150, the second capillary tube 160, and the evaporator 170 are connected through a connecting pipe so that a closed loop refrigerant circuit in which the refrigerant circulates may be provided in the refrigerator 1.

Figure 3:
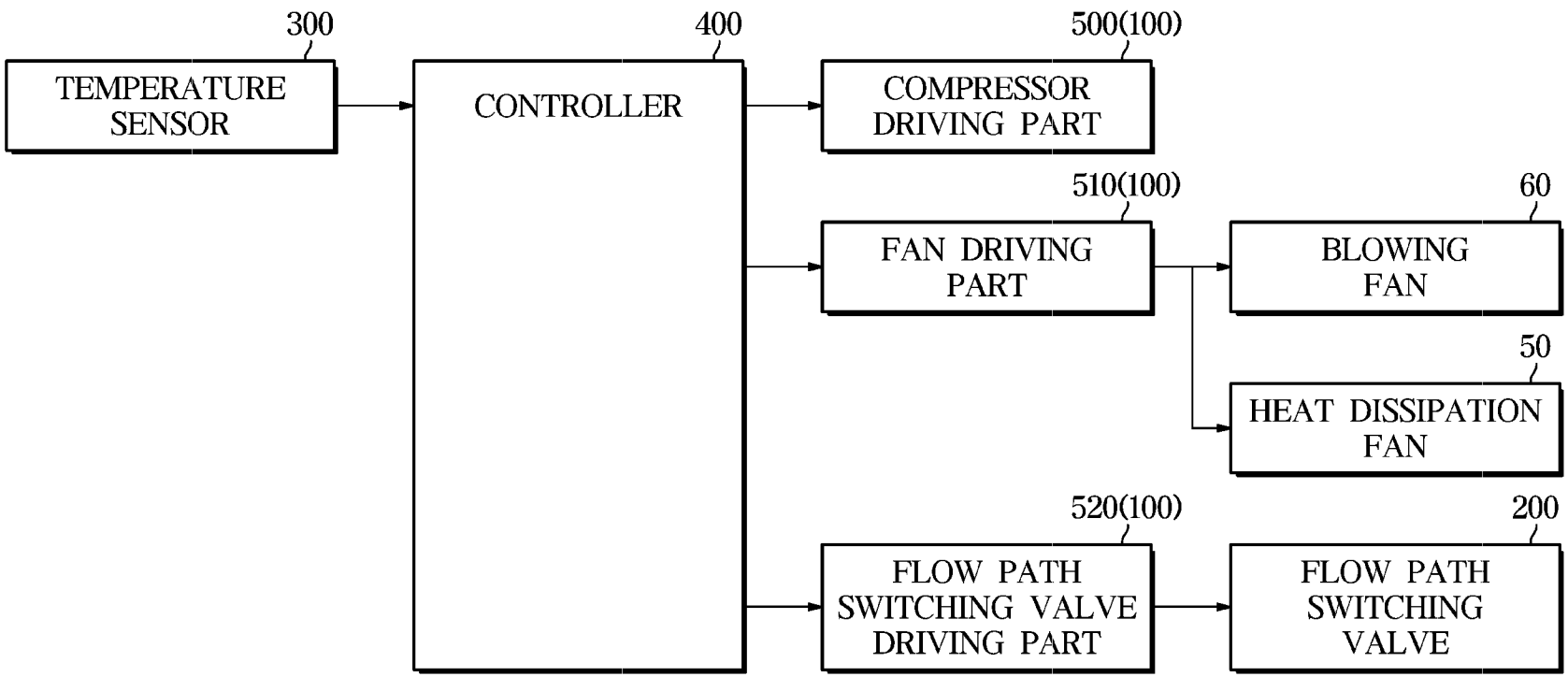
FIG. 3 is a control block diagram illustrating the refrigerator according to an embodiment of the disclosure.

FIG. 3 is a control block diagram illustrating the refrigerator according to an embodiment of the disclosure.

The refrigerator 1 according to the embodiment of the disclosure provides various cooling modes through control of the controller 400, such as a microcomputer.

In FIG. 3, a block diagram of a control system based on the controller 400 provided in the refrigerator 1 according to an embodiment of the disclosure is illustrated.

Referring to FIG. 3, the refrigerator 1 may include a temperature sensor 300 and a controller 400. The temperature sensor 300 may be connected to an input port of the controller 400.

The temperature sensor 300 may be provided to detect an external temperature which is an indoor temperature outside the refrigerator. The temperature sensor 300 may provide the controller 400 with the detected temperature information.

The controller 400 may be provided to control the cold air supply device 100 based on the external temperature detected by the temperature sensor 300. The cold air supply device 100 may include a compressor driving part 500, a fan driving part 510, and a flow path switching valve driving part 520. Accordingly, the compressor driving part 500, the fan driving part 510, and the flow path switching valve driving part 520 may be connected to an output port of the controller 400.

The compressor driving part 500 may be provided to drive the compressor 110, the fan driving part 510 may be provided to drive the blowing fan 60 and the heat dissipation fan 50, and the flow path switching valve driving part 520 may be provided to drive the flow path switching valve 200.

The compressor driving part 500 may be provided to control ON/OFF of the compressor 110 and a driving speed of the compressor 110. The fan driving part 510 may be provided to control driving speeds of the blowing fan 60 and the heat dissipation fan 50. In other words, the fan driving part 510 may be provided to control a driving revolutions per minute (RPM) of the blowing fan 60 and the heat dissipation fan 50.

The flow path switching valve driving part 520 may be provided to control the opening and closing of the flow path switching valve 200. In more detail, the flow path switching valve driving part 520 may control the flow path switching valve 200 to be opened toward the first capillary tube 150 or be opened toward the second capillary tube 160. The flow path switching valve 200 may be provided as a three-way valve to change the circuit in which the refrigerant flows.

Figure 4:
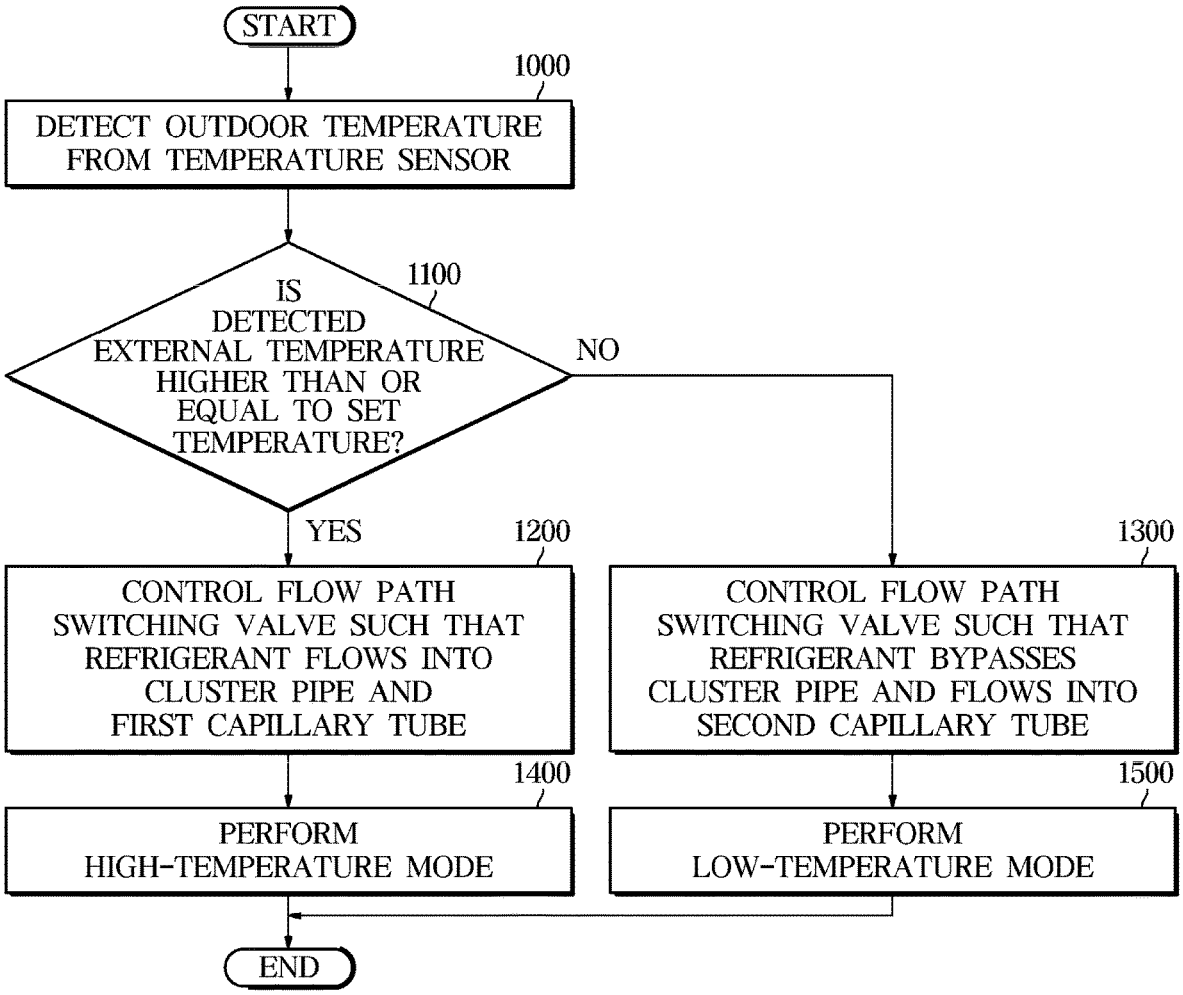
FIG. 4 is a flowchart showing a method of controlling the refrigerator according to an embodiment of the disclosure.

FIG. 4 is a flowchart showing a method of controlling the refrigerator according to an embodiment of the disclosure.

The controller 400 controls the flow path switching valve 200 to implement various cooling modes. More specifically, the controller 400 may receive the temperature information detected by the temperature sensor 300 and control the cold air supply device 100 to operate in a high temperature mode or a low temperature mode.

Referring to FIGS. 2 to 4, the refrigerator 1 may detect an external temperature from the temperature sensor 300 (1000).

The controller 400 may receive information about the detected external temperature.

The controller 400 may identify whether the detected external temperature is higher than or equal to a set temperature (1100).

As the measurement standard for power consumption has recently been changed, the power consumption of the refrigerator 1 is measured under conditions when the external temperatures are 32° C. and 16° C. Accordingly, the set temperature may be provided at a temperature between approximately 23 and 25 degrees. However, the range of the set temperature is not limited thereto.

When it is identified that the detected external temperature is higher than or equal to the set temperature, the controller 400 may control the flow path switching valve 200 such that the refrigerant flows into the cluster pipe 140 and the first capillary tube 150 (1200).

More specifically, the controller 400 may control the flow path switching valve 200 to be opened toward the cluster pipe 140 and the first capillary tube 150. That is, the controller 400 may control the flow path switching valve 200 to be closed to the second capillary tube 160.

With such a configuration, the high-temperature mode may be performed (1400).

The high-temperature mode is a mode in which the refrigerant sequentially flows through the cluster pipe 140 and the first capillary tube 150 when the external temperature is higher than or equal to the set temperature.

When it is identified that the detected external temperature is lower than the set temperature, the controller 400 may control the flow path switching valve 200 such that the refrigerant bypasses the cluster pipe 140 and flows into the second capillary tube 160 (1300).

In more detail, the controller 400 may control the flow path switching valve 200 to be opened toward the second capillary tube 160. That is, the controller 400 may control the flow path switching valve 200 to be closed to the cluster pipe 140 and the first capillary tube 150.

With such a configuration, the low temperature mode may be performed (1500).

Accordingly, the low-temperature mode is a mode in which the refrigerant bypasses the cluster pipe 140 and flows through the second capillary tube 160 when the external temperature is lower than the set temperature.

Thereafter, the refrigerant passing through the cluster pipe 140, and the first capillary tube 150 or the second capillary tube 160 is subject to a phase change from a liquid to a gas while passing through the evaporator 170, to generate cold air through an endothermic reaction from the surrounding air.

That is, the first capillary tube 150 allows the refrigerant to flow therethrough in the high temperature mode, and the second capillary tube 160 allows the refrigerant to flow therethrough in the low temperature mode.

As the cluster pipe 140 is connected in series with the first capillary tube 150, the refrigerant bypasses the cluster pipe 140 in the low temperature mode.

In general, for each case of when the ambient temperature of the refrigerator 1 is high and when the ambient temperature of the refrigerator is low, the difference between the ambient temperature and the temperature of the storage chamber is subject to change, so that a required flow rate of the refrigerant flowing through the refrigeration cycle is also subject to change.

In the conventional technology, the required amount of refrigerant is not considered. Accordingly, when the ambient temperature is relatively low, the refrigerant is super-cooled and the pressure inside the cold air supply device 100 is lowered. In this case, since a sufficient amount of refrigerant does not pass through the capillary tube, a refrigerant shortage occurs in the evaporator 170 side, and cooling efficiency may be reduced.

Therefore, the disclosure improves the structure of the refrigerator such that a refrigerant bypasses the cluster pipe 140 to prevent the refrigerant from being super-cooled when the ambient temperature is relatively low.

In addition, the first capillary tube 150 and the second capillary tube 160 are provided to have different tube diameters and lengths, and the resistance when the refrigerant flows through the second capillary tube 160 is provided to be greater than that when the refrigerant flows through the first capillary tube 150, to thereby prevent the refrigerant from being super-cooled in a low ambient temperature condition.

In addition, the driving RPM of the heat dissipation fan 50 when the low-temperature mode is performed is controlled to be lower than that in the high-temperature mode, to thereby prevent—of the refrigerant at the condenser 120 side.

According to the recently changed measurement standard for power consumption, the power consumptions are measured in both external temperature conditions of 32 degree and 16 degree. Accordingly, there is a need for power consumption reduction in the low ambient temperature environment.

The refrigerator 1 according to an embodiment of the disclosure may achieve a constant cooling efficiency regardless of the ambient temperature, so that power consumption may be improved in both the high-temperature mode and the low-temperature mode.

Figure 5:
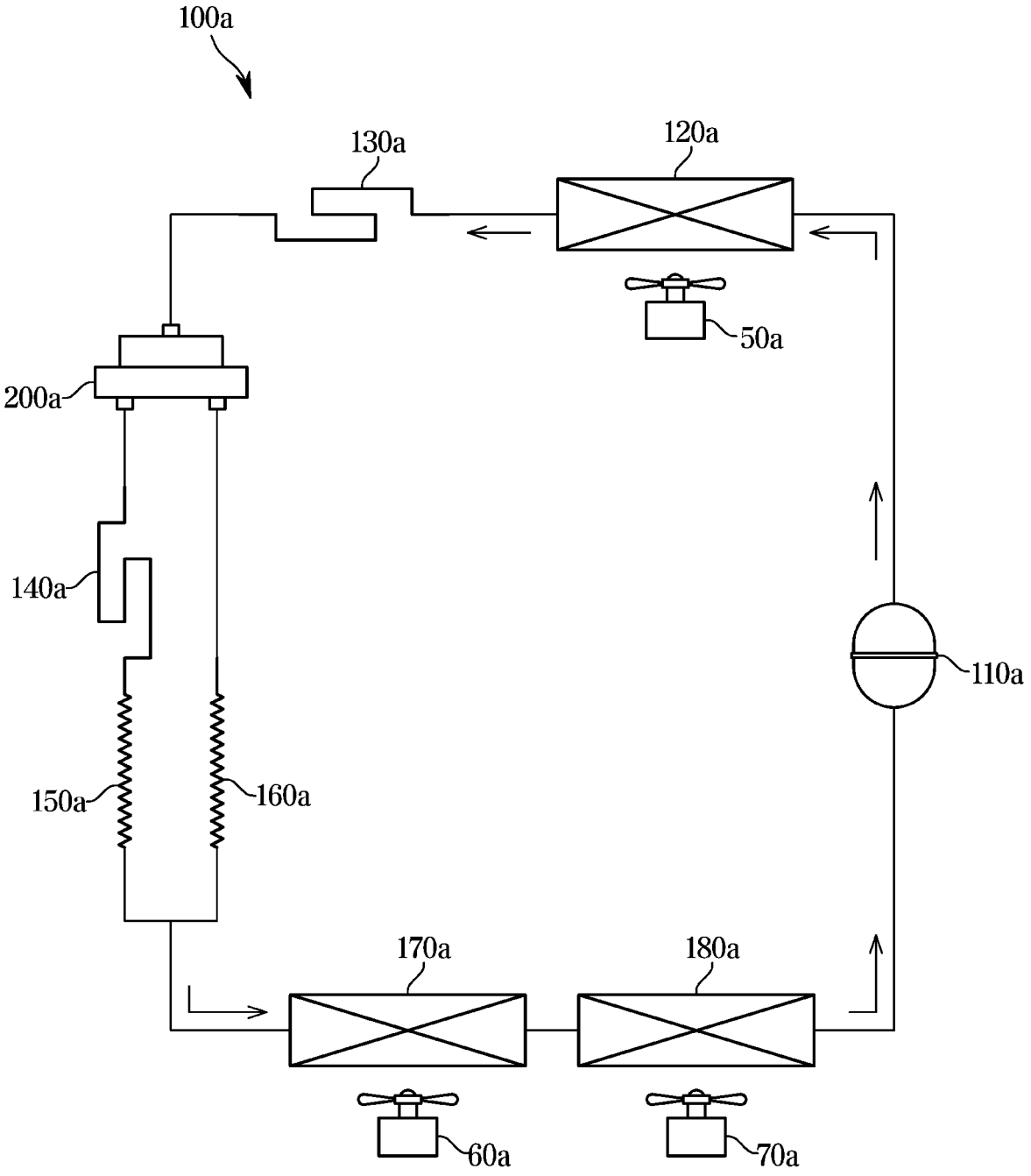
FIG. 5 is a circuit diagram illustrating a cold air supply device of a refrigerator according to another embodiment of the disclosure.
Figure 6:
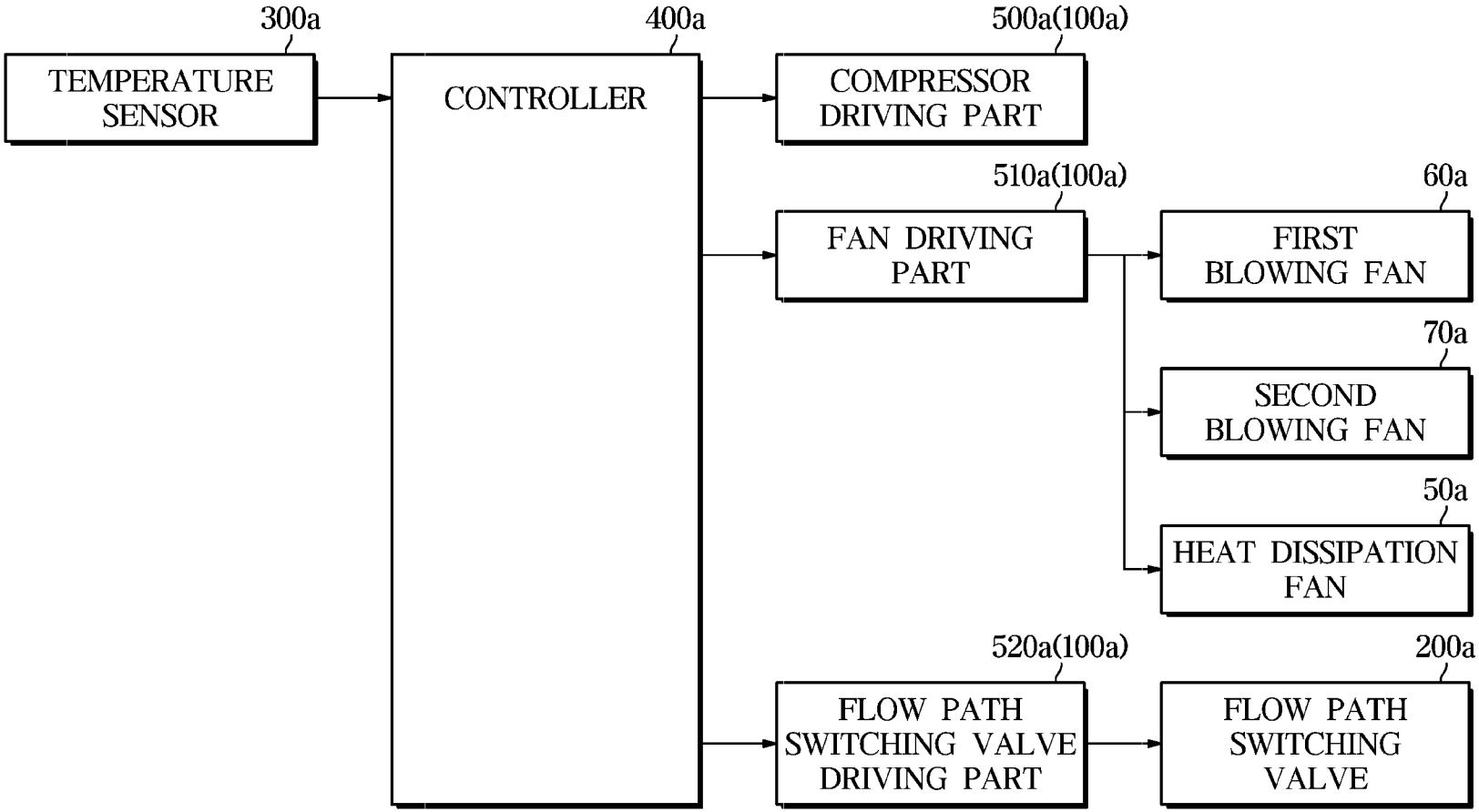
FIG. 6 is a control block diagram illustrating the refrigerator according to an embodiment of the disclosure.

FIG. 5 is a circuit diagram illustrating a cold air supply device of a refrigerator according to another embodiment of the disclosure. FIG. 6 is a control block diagram illustrating the refrigerator according to an embodiment of the disclosure.

The following description will be made mainly on differences from the refrigerator according to an embodiment of the disclosure. Components not described below may be provided with the same structure and denoted by the same reference numerals as those of the refrigerator according to an embodiment of the disclosure.

Referring to FIG. 5, the refrigerator according to the embodiment of the disclosure may include a cold air supply device 100*a* for supplying cold air into the storage chamber.

Unlike the cold air supply device 100 of the refrigerator according to an embodiment of the disclosure, the cold air supply device 100*a* of the refrigerator according to an embodiment of the disclosure may include a plurality of evaporators 170*a* and 180*a*. The plurality of evaporators 170*a* and 180*a* may include a first evaporator 170*a* disposed in the refrigerating chamber and a second evaporator 180*a* disposed in the freezing chamber. The plurality of evaporators 170*a* and 180*a* may be provided to be connected in series to each other.

The cold air supply device 100*a* of the refrigerator according to the embodiment of the disclosure may include a compressor 110*a* and a condenser 120*a*.

The compressor 110*a* may be provided to compress a refrigerant provided to circulate the cold air supply device 100*a* into a high-temperature and high-pressure gas.

The condenser 120*a* may be provided to condense the refrigerant compressed in the compressor 110*a*. Specifically, the condenser 120*a* may be provided to radiate heat of the high-temperature and high-pressure gas refrigerant compressed in the compressor 110*a* such that the high-temperature and high-pressure gas refrigerant is subject to phase-change into a liquid at a room temperature.

The cold air supply device 100*a* may include a hot pipe 130*a*. The hot pipe 130*a* may be installed at a circumference of the main body 10 of the refrigerator to prevent water vapor from condensing on a portion in which the door and the main body 10 come in contact with each other. The hot pipe 130*a* may be disposed between the condenser 120*a* and a flow path switching valve 200*a*.

The working refrigerant flowing through the cold air supply device 100*a* may include HC-based isobutane (R600a), propane (R290), HFC-based R134a, and HFO-based R1234yf. However, the type of the refrigerant is not limited, and the refrigerant may be provided in any other type as long as it can reach a target temperature through heat exchange with the surroundings.

The cold air supply device 100*a* may include a flow path switching valve 200*a*, a first capillary tube 150*a*, and a second capillary tube 160*a*. In addition, the cold air supply device 100*a* may include a cluster pipe 140*a*.

The first capillary tube 150*a* may be connected at the outlet side of the condenser 120*a*. The second capillary tube 160*a* may be connected at the outlet side of the condenser 120*a*. More specifically, the second capillary tube 160*a* may be connected in parallel with the first capillary tube 150*a*. In this case, the connection at the outlet side of the condenser 120*a* refer to being provided at a downstream side of the condenser 120*a* with respect to the flow direction of the refrigerant The first capillary tube 150*a* and the second capillary tube 160*a* may have different tube diameters and lengths. More specifically, the second capillary tube 160*a* may have a length longer than that of the first capillary tube 150*a*.

The refrigerant expands while flowing through the first capillary tube 150*a* or the second capillary tube 160*a*, to be lowered in the pressure.

The refrigerant may selectively flow into the first capillary tube 150*a* or the second capillary tube 160*a* according to the operation of a high-temperature mode or a low-temperature mode.

The flow path switching valve 200*a* may be connected at the outlet side of the condenser 120*a*. The first capillary tube 150*a* and the second capillary tube 160*a* may be connected in parallel with each other at the outlet side of the flow path switching valve 200*a*.

The flow path switching valve 200*a* may be provided such that the refrigerant having passed through the condenser 120*a* flows into the first capillary tube 150*a* or the second capillary tube 160*a*. That is, the refrigerant may selectively flow into the first capillary tube 150*a* or the second capillary tube 160*a* according to control of the flow path switching valve 200*a*.

The cluster pipe 140*a* may be provided to assist in the condensation of the refrigerant. More specifically, the cluster pipe 140*a* may be provided to additionally radiate a high-temperature refrigerant to serve as an auxiliary condenser 120*a*.

The cluster pipe 140*a* may be disposed between the flow path switching valve 200*a* and the first capillary tube 150*a*. With such a configuration, the refrigerant may pass through the cluster pipe 140*a* only when the flow path switching valve 200*a* is controlled to be opened toward the first capillary tube 150*a*. In other words, when the flow path switching valve 200*a* is controlled to be opened toward the second capillary tube 160*a*, the refrigerant may not pass through the cluster pipe 140*a*.

The cold air supply device 100*a* may include a plurality of evaporators 170*a* and 180*a*. The plurality of evaporators 170*a* and 180*a* may be provided to be connected at the outlet side of the first capillary tube 150*a* and the second capillary tube 160*a* that are connected in parallel with each other. The plurality of evaporators 170*a* and 180*a* are provided to allow the refrigerant, which has been expanded in the first capillary tube 150*a* or the second capillary tube 160*a* into a low-pressure liquid state, to be phase-change into a gas to absorb surrounding heat. In other words, the plurality of evaporators 170*a* and 180*a* may be provided to evaporate the refrigerant.

The cold air supply device 100*a* may include a heat dissipation fan 50*a* and a plurality of blowing fans.

The heat dissipation fan 50*a* may be provided adjacent to the condenser 120*a*. The plurality of blowing fans 60*a* and 70*a* may be provided adjacent to the plurality of evaporators 170*a* and 180*a*. The plurality of blowing fans 60*a* and 70*a* may include a first blowing fan 60*a* disposed adjacent to the first evaporator 170*a* and a second blowing fan 70*a* disposed adjacent to the second evaporator 180*a*.

The heat dissipation fan 50*a* may be provided to increase the heat dissipation efficiency of the condenser 120*a*. The plurality of blowing fans 60*a* and 70*a* may be provided to increase the evaporation efficiency of the plurality of evaporators 170*a* and 180*a*, respectively.

The compressor 110*a*, the condenser 120*a*, the hot pipe 130*a*, the flow path switching valve 200*a*, the first capillary tube 150*a*, the second capillary tube 160*a*, and the plurality of evaporators 170*a* and 180*a* are connected to each other through a connecting pipe so that a closed loop refrigerant circuit in which the refrigerant circulates may be provided in the refrigerator.

Accordingly, in the refrigerator according to the embodiment of the disclosure, since the plurality of evaporators 170*a* and 180*a* are provided, cooling of the refrigerating chamber may be performed and then cooling of the freezing chamber may be performed in a sequential manner.

In addition, the refrigerator according to the embodiment of the disclosure provides various cooling modes through control of a controller 400*a* such as a microcomputer.

In FIG. 6, a block diagram of a control system based on the controller 400*a* provided in the refrigerator according to the embodiment of the disclosure is illustrated.

Referring to FIG. 6, the refrigerator may include a temperature sensor 300*a* and a controller 400*a*. The temperature sensor 300*a* may be connected to an input port of the controller 400*a*.

The temperature sensor 300*a* may be provided to detect the external temperature. The temperature sensor 300*a* may provide the controller 400*a* with detected temperature information.

The controller 400*a* may be provided to control the cold air supply device 100*a* based on the external temperature detected by the temperature sensor 300*a*. The cold air supply device 100*a* may include a compressor driving part 500*a*, a fan driving part 510*a*, and a flow path switching valve driving part 520*a*. Accordingly, the compressor driving part 500*a*, the fan driving part 510*a*, and the flow path switching valve driving part 520*a* may be connected to an output port of the controller 400*a*.

The compressor driving part 500*a* may be provided to drive the compressors 110, the fan driving part 510*a* may be provided to drive the first blowing fan 60*a*, the second blowing fan 70*a*, and the heat dissipation fan 50*a*, and the flow path switching valve driving part 520*a* may be provided to drive the flow path switching valve 200*a*.

The compressor driving part 500*a* may be provided to control ON/OFF of the compressor 110*a* and a driving speed of the compressor 110*a*. The fan driving part 510*a* may be provided to control driving speeds of the first blowing fan 60*a*, the second blowing fan 70*a*, and the heat dissipation fan 50*a*. In other words, the fan driving part 510*a* may be provided to control a driving revolutions per minute (RPM) of the first blowing fan 60*a*, the second blowing fan 70*a*, and the heat dissipation fan 50*a*.

The flow path switching valve driving part 520*a* may be provided to control the opening and closing of the flow path switching valve 200*a*. In more detail, the flow path switching valve driving part 520*a* may control the flow path switching valve 200*a* to be opened toward the first capillary tube 150*a* or be opened toward the second capillary tube 160*a*. The flow path switching valve 200*a* may be provided as a three-way valve to change the circuit in which the refrigerant flows.

Unlike the refrigerator according to an embodiment of the disclosure, the refrigerator according to the embodiment of the disclosure includes a plurality of evaporators 170*a* and 180*a*, and the fan driving part 510*a* is configured to control each of the first blowing fan 70*a*, the second blowing fan 70*a*, and the heat dissipation fan 50*a*.

In addition, the refrigerator according to the embodiment of the disclosure has a refrigeration cycle similar to that of the refrigerator according to an embodiment of the disclosure, except that the evaporators 170*a* and 180*a* are provided in plural and the blowing fans 60*a* and 70*a* are provided in plural. Accordingly, the flowchart related to the control method of the refrigerator according to the embodiment of the disclosure may be provided in the same manner as the flowchart related to the control method of the refrigerator according to an embodiment of the disclosure.

Figure 7:
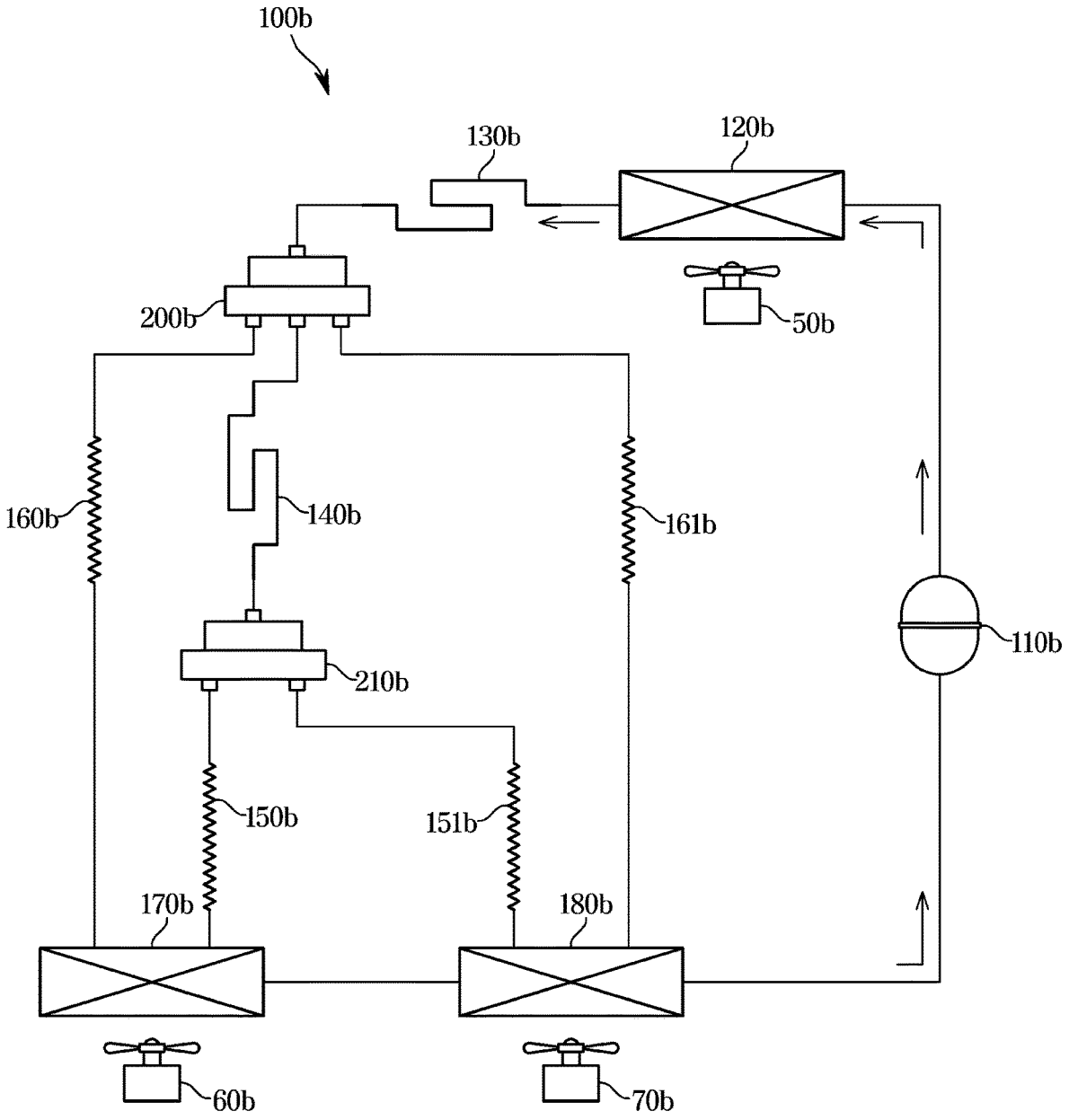
FIG. 7 is a circuit diagram illustrating a cold air supply device of a refrigerator according to still another embodiment of the disclosure.
Figure 8:
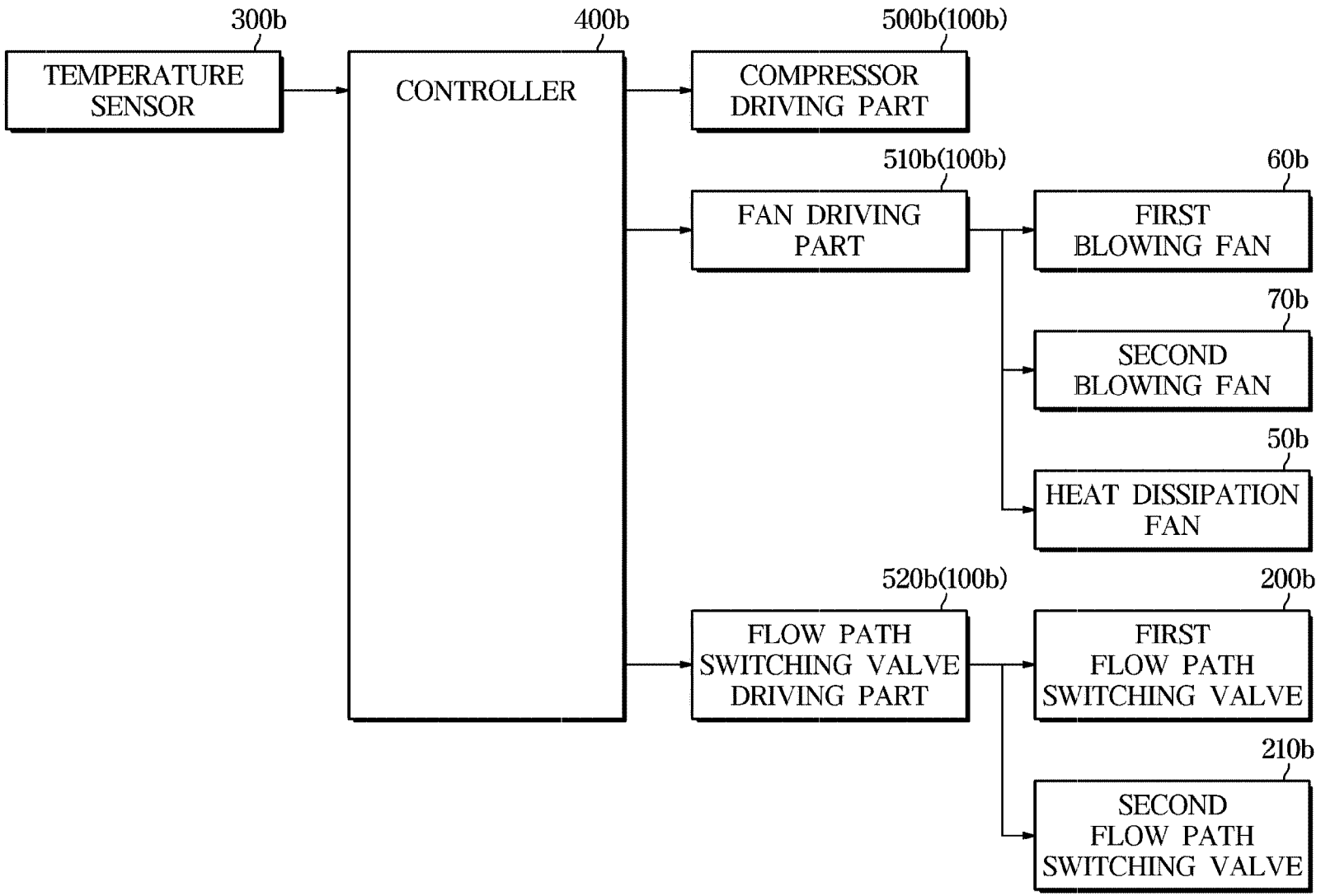
FIG. 8 is a control block diagram illustrating the refrigerator according to an embodiment of the disclosure.
Figure 9A:
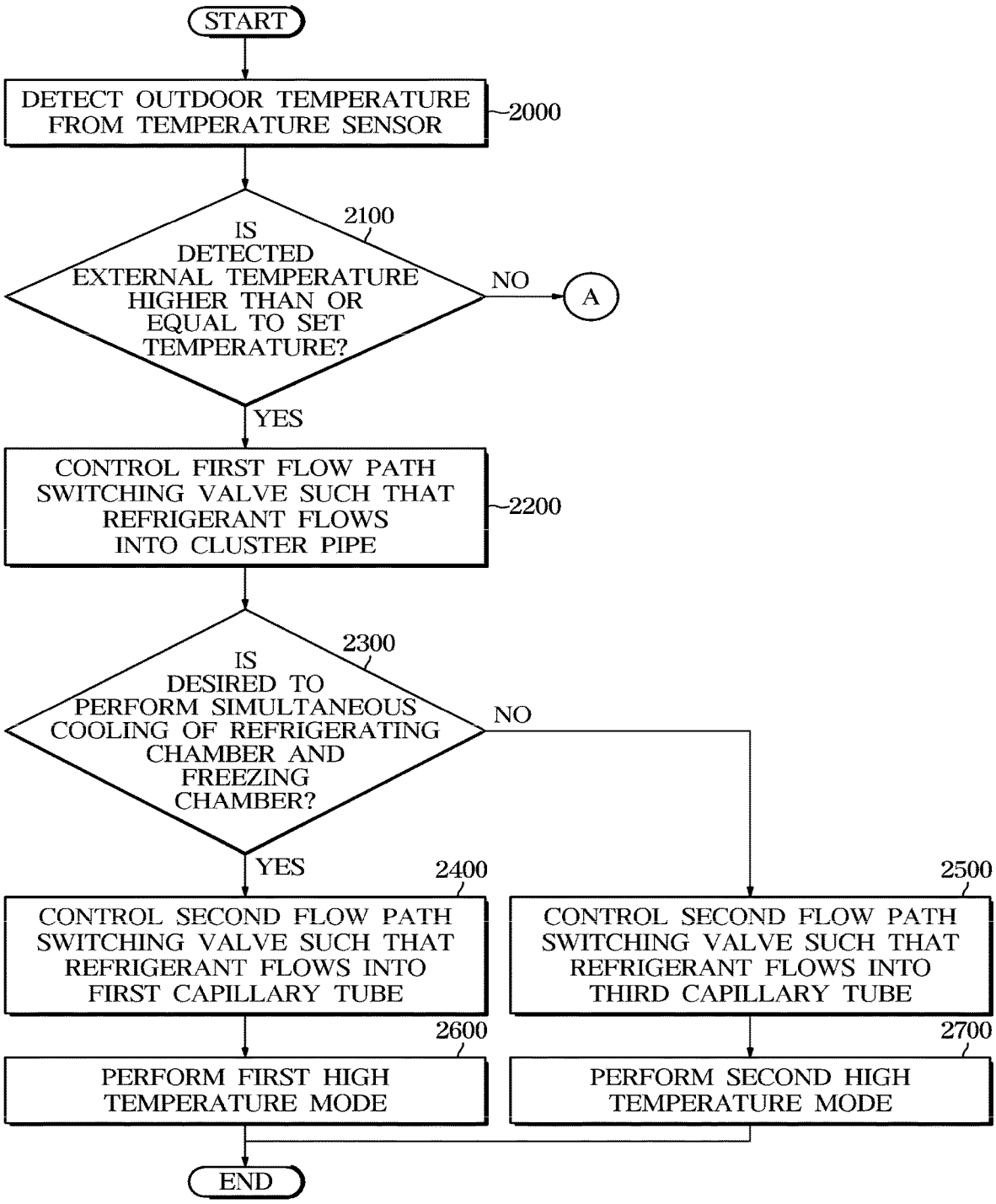
FIGS. 9A and 9B flowcharts showing a method of controlling the refrigerator according to an embodiment of the disclosure.
Figure 9B:
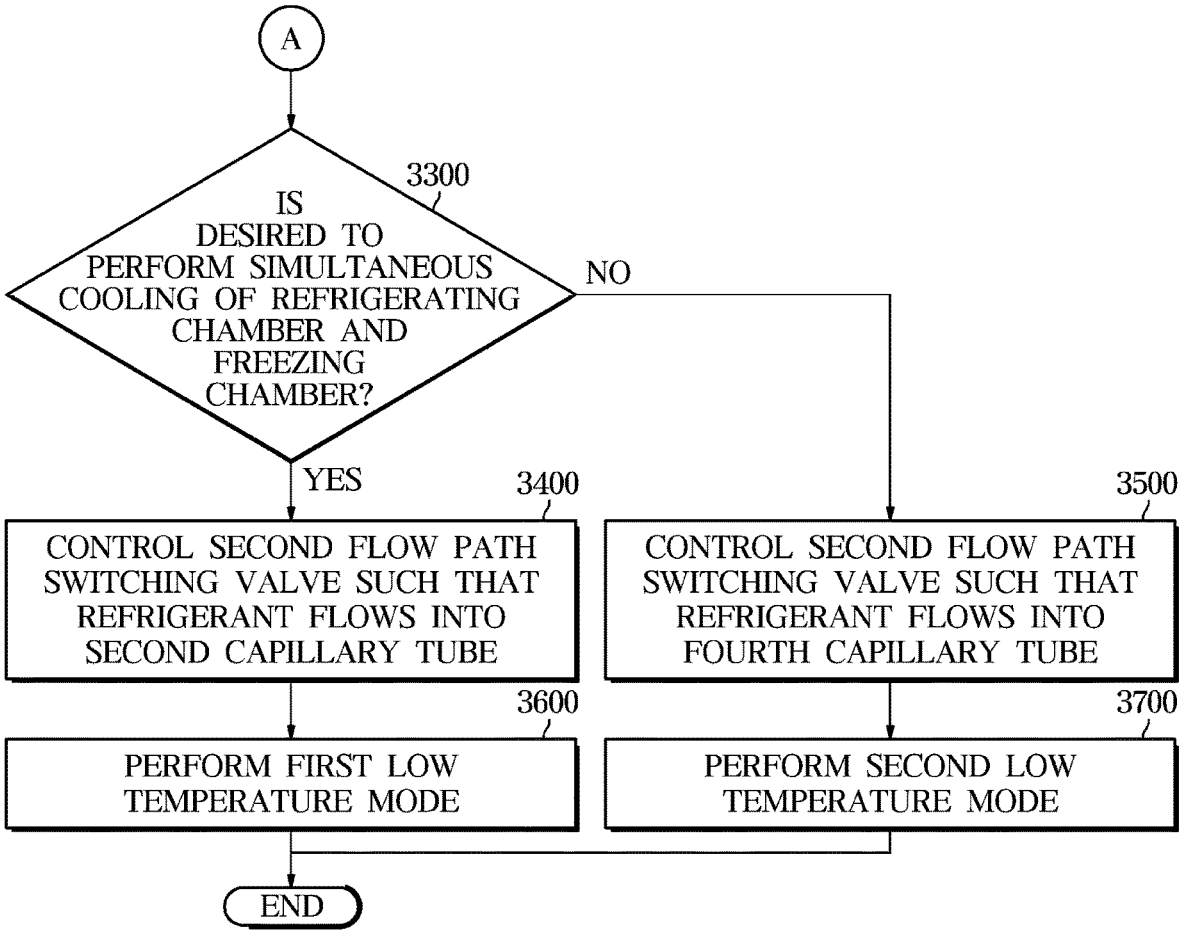

FIG. 7 is a circuit diagram illustrating a cold air supply device of a refrigerator according to still another embodiment of the disclosure, FIG. 8 is a control block diagram illustrating the refrigerator according to an embodiment of the disclosure, and FIGS. 9A and 9B are flowcharts showing a method of controlling the refrigerator according to an embodiment of the disclosure.

Referring to FIG. 7, the refrigerator according to the embodiment of the disclosure may include a cold air supply device 100*b* for supplying cold air into the storage chamber.

Unlike the cold air supply device 100 of the refrigerator according to an embodiment of the disclosure, the cold air supply device 100*b* of the refrigerator according to the embodiment of the disclosure may include a plurality of evaporators. The plurality of evaporators may include a first evaporator 170*b* disposed in the refrigerating chamber and a second evaporator 180*b* disposed in the freezing chamber. The plurality of evaporators may be provided to be connected in series with each other.

In addition, the cold air supply device 100*b* of the refrigerator according to an embodiment of the disclosure is provided as a time-divided cold air supply device 100*b* in which the refrigerant flows in series through the first evaporator 170*b* of the refrigerating chamber and the second evaporator 180*b* of the freezing chamber for a predetermined time, and when the predetermined time has elapsed, the refrigerant flows only through the evaporator of the freezing chamber. Details thereof will be described with reference to FIG. 7.

The cold air supply device 100*b* of the refrigerator according to the embodiment of the disclosure may include a compressor 110*b* and a condenser 120*b*.

The compressor 110*b* may be provided to compress a refrigerant provided to circulate the cold air supply device 100*b* into a high-temperature and high-pressure gas.

The condenser 120*b* may be provided to condense the refrigerant compressed in the compressor 110*b*. Specifically, the condenser 120*b* may be provided to radiate heat to the high-temperature and high-pressure gas refrigerant compressed in the compressor 110*b* such that the high-temperature and high-pressure gas refrigerant is subject to phase-change into a liquid at a room temperature.

The cold air supply device 100*b* may include a hot pipe 130*b*. The hot pipe 130*b* may be installed at a circumference of the main body of the refrigerator to prevent water vapor from condensing at a portion in which the door and the main body of the refrigerator come in contact each other. The hot pipe 130*b* may be disposed between the condenser 120*b* and a first flow path switching valve 200*b*.

The working refrigerant flowing through the cold air supply device 100*b* may include HC-based isobutane (R600a), propane (R290), HFC-based R134a, and HFO-based R1234yf. However, the type of refrigerant is not limited, and the refrigerant may be provided in any other type as long as it can reach a target temperature through heat exchange with the surroundings.

The cold air supply device 100*b* may include a first flow path switching valve 200*b*, a second flow path switching valve 210*b*, a first capillary tube 150*b*, a second capillary tube 160*b*, a third capillary tube 151*b*, and a fourth capillary tube 161*b*. In addition, the cold air supply device 100*b* may include a cluster pipe 140*b*.

The cluster pipe 140*b*, the second capillary tube 160*b*, and the fourth capillary tube 161*b* may be connected in parallel with each other at the outlet side of the first flow path switching valve 200*b*. The first flow path switching valve 200*b* may be provided such that the refrigerant flows into one of the cluster pipe 140*b*, the second capillary tube 160*b*, and the fourth capillary tube 161*b*.

The second flow path switching valve 210*b* may be disposed at the outlet side of the cluster pipe 140*b*.

The first capillary tube 150*b* and the third capillary tube 151*b* may be connected in parallel with each other at the outlet side of the second flow path switching valve 210*b*. Accordingly, the second flow path switching valve 210*b* may be provided such that the refrigerant having passed through the cluster pipe 140*b* flows into the first capillary tube 150*b* or the third capillary tube 151*b*.

The first capillary tube 150*b* and the second capillary tube 160*b* may be provided to have different tube diameters and lengths. In addition, the third capillary tube 151*b* and the fourth capillary tube 161*b* may be provided to have different tube diameters and lengths. More specifically, the second capillary tube 160*b* may be provided to have a length longer than that of the first capillary tube 150*b*, and the fourth capillary tube 161*b* may be provided to have a length shorter than that of the third capillary tube 151*b*. In addition, the first capillary tube 150*b* and the third capillary tube 151*b* may be provided to be identical to each other, and the second capillary tube 160*b* and the fourth capillary tube 161*b* may be provided to be identical to each other.

The refrigerant expands while flowing through one of the first capillary tube 150*b* to the fourth capillary tube 161*b*, to be lowered in the pressure.

According to the operation of a first high-temperature mode, a second high-temperature mode, a first low-temperature mode, and a second low-temperature mode, which will be described below, the refrigerant may flow into one of the first capillary tube 150*b* to the fourth capillary tube 161*b*. Details thereof will be described below.

The cluster pipe 140*b* may be provided to assist in the condensation of the refrigerant. More specifically, the cluster pipe 140*b* may be provided to additionally radiate a high-temperature refrigerant to serve as an auxiliary condenser 120*b*.

The cluster pipe 140*b* may be disposed between the first flow path switching valve 200*b* and the second flow path switching valve 210*b*. With such a configuration, the refrigerant may pass through the cluster pipe 140*b* only when the first flow path switching valve 200*b* is controlled to be opened toward the second flow path switching valve 210*b*. In other words, when the first flow path switching valve 200*b* is controlled to be opened toward the second capillary tube 160*b* or the fourth capillary tube 161*b*, the refrigerant may not pass through the cluster pipe 140*b*.

The cold air supply device 100*b* may include a plurality of evaporators. The plurality of evaporators may be provided to be connected in series with each other at the outlet side of the first capillary tube 150*b* to the fourth capillary tube 161*b* connected in parallel. More specifically, the first evaporator 170*b* is connected to the first capillary tube 150*b* and the second capillary tube 160*b*, and the second evaporator 180*b* is connected to the third capillary tube 151*b* and the fourth capillary tube 161*b*. In addition, the first evaporator 170*b* and the second evaporator 180*b* may be connected in series with each other.

The plurality of evaporators are provided to allow the refrigerant, which has been expanded in the first capillary tube 150*b* to the fourth capillary tube 161*b* into a low-pressure liquid state, to be subject to phase-change into a gas to absorb surrounding heat. In other words, the plurality of evaporators may be provided to evaporate the refrigerant.

The first evaporator 170*b* may be connected to the first capillary tube 150*b*. The first evaporator 170*b* may be connected to the second capillary tube 160*b*. The first evaporator 170*b* may be disposed in the refrigerating chamber to supply cold air to the refrigerating chamber.

The second evaporator 180*b* may be connected to the third capillary tube 151*b*. The second evaporator 180*b* may be connected to the fourth capillary tube 161*b*. The second evaporator 180*b* may be disposed in the freezing chamber to supply cold air to the freezing chamber.

The cold air supply device 100*b* may include a heat dissipation fan 50*b* and a plurality of blowing fans 60*b*, 70*b*.

The heat dissipation fan 50*b* may be provided adjacent to the condenser 120*b*. The plurality of blowing fans may be provided adjacent to the plurality of evaporators. The plurality of blowing fans may include a first blowing fan 60*b* disposed adjacent to the first evaporator 170*b* and a second blowing fan 70*b* disposed adjacent to the second evaporator 180*b*.

The heat dissipation fan 50*b* may be provided to increase the heat dissipation efficiency of the condenser 120*b*. The plurality of blowing fans may be provided to increase the evaporation efficiency of the plurality of evaporators, respectively.

The compressor 110*b*, the condenser 120*b*, the hot pipe 130*b*, the first and second flow path switching valves, the first capillary tube 150*b* to the fourth capillary tube 161*b*, and the plurality of evaporators are connected to each other through a connecting tube so that a closed-loop refrigerant circuit in which the refrigerant circulates may be provided in the refrigerator.

Referring to FIG. 8, the refrigerator according to the embodiment of the disclosure provides various cooling modes through control of a controller 400*b* such as a microcomputer.

In FIG. 8, is a block diagram of a control system based on the controller 400*b* provided in the refrigerator according to the embodiment of the disclosure is illustrated.

Referring to FIG. 8, the refrigerator may include a temperature sensor 300*b* and a controller 400*b*. The temperature sensor 300*b* may be connected to an input port of the controller 400*b*.

The temperature sensor 300*b* may be provided to detect the external temperature. The temperature sensor 300*b* may provide the controller 400*b* with detected temperature information.

The controller 400*b* may be provided to control the cold air supply device 100*b* based on the external temperature detected by the temperature sensor 300*b*. The cold air supply device 100*b* may include a compressor driving part 500*b*, a fan driving part 510*b*, and a flow path switching valve driving part 520*b*. Accordingly, the compressor driving part 500*b*, the fan driving part 510*b*, and the flow path switching valve driving part 520*b* may be connected to an output port of the controller 400*b*.

The compressor driving part 500*b* may be provided to drive the compressor 110*b*, and the fan driving part 510*b* may be provided to drive the first blowing fan 60*b*, the second blowing fan 70*b*, and the heat dissipation fan 50*b*, and the flow path switching valve driving part 520*b* may be provided to drive the first flow path switching valve 200*b* and the second flow path switching valve 210*b*.

The compressor driving part 500*b* may be provided to control ON/OFF of the compressor 110*b* and a driving speed of the compressor 110*b*. The fan driving part 510*b* may be provided to control the driving speeds of the first blowing fan 60*b*, the second blowing fan 70*b*, and the heat dissipation fan 50*b*. In other words, the fan driving part 510*b* may be provided to control the driving RPM of the first blowing fan 60*b*, the second blowing fan 70*b*, and the heat dissipation fan 50*b*.

The flow path switching valve driving part 520*b* may be provided to control the opening and closing of the first flow path switching valve 200*b* and the second flow path switching valve 210*b*. More specifically, the flow path switching valve driving part 520*b* may control the first flow path switching valve 200*b* such that the first flow path switching valve 200*b* is be opened toward one of the second capillary tube 160*b*, the fourth capillary tube 161*b*, and the cluster pipe 140*b*. In addition, the flow path switching valve driving part 520*b* may control the second flow path switching valve 210*b* to be opened toward the first capillary tube 150*b* or to be opened toward the third capillary tube 151*b*. The first flow path switching valve 200*b* and the second flow path switching valve 210*b* may be provided as a four-way valve or a three-way valve to change a circuit in which the refrigerant flows.

Unlike the refrigerator according to an embodiment of the disclosure, the refrigerator according to the embodiment of the disclosure includes a plurality of evaporators, and thus the fan driving part 510*b* may be provided to control each of the first blowing fan 60*b*, the second blowing fan 70*b*, and the heat dissipation fan 50*b*. In addition, since the flow path switching valve is provided in plural, the flow path switching valve driving part 520*b* may be provided to control both the first flow path switching valve 200*b* and the second flow path switching valve 210*b*.

Referring to FIGS. 7 to 9B, the controller 400*b* controls the first flow path switching valve 200*b* and the second flow path switching valve 210*b* to implement various cooling modes. In more detail, the controller 400*b* may receive the temperature information detected by the temperature sensor 300*b* and control the cold air supply device 100*b* to operate in the first high temperature mode, the second high temperature mode, the first low temperature mode, or the second low temperature mode.

Referring to FIGS. 7 to 9B, the refrigerator may detect an external temperature from the temperature sensor 300*b* (2000).

The controller 400*b* may receive information about the detected external temperature.

The controller 400*b* may identify whether the detected external temperature is higher than or equal to a set temperature (2100).

As the measurement standard for power consumption has recently been changed, the power consumption of the refrigerator 1 is measured under conditions when the external temperatures are 32° C. and 16° C. Accordingly, the set temperature may be provided at a temperature between approximately 23 and 25 degrees. However, the range of the set temperature is not limited thereto.

When it is identified that the detected external temperature is higher than or equal to the set temperature, the controller 400*b* may control the first flow path switching valve 200*b* such that the refrigerant flows into the cluster pipe 140*b* (2200).

In addition, the controller 400*b* may identify whether to simultaneously perform cooling of the refrigerating chamber and cooling of the freezing chamber (2300).

When it is desired to simultaneously performing cooling of the refrigerating chamber and cooling of the freezing chamber, the controller 400*b* may control the second flow path switching valve 210*b* such that the refrigerant flows into the first capillary tube 150*b* (2400).

More specifically, the controller 400*b* may control the second flow path switching valve 210*b* such that the refrigerant having passed through the cluster pipe 140*b* flows into the first capillary tube 150*b*. Thereafter, the refrigerant may flow into the first evaporator 170*b* connected to the first capillary tube 150*b*.

Accordingly, the first high temperature mode is performed (2600).

That is, the first high-temperature mode is a mode in which the refrigerant sequentially passes through the compressor 110*b*, the condenser 120*b*, the hot pipe 130*b*, and the first flow path switching valve 200*b*, the cluster pipe 140*b*, the first capillary tube 150*b*, the first evaporator 170*b*, and the second evaporator 180*b*. Accordingly, when the ambient temperature is high and the freezing chamber and the refrigerating chamber are simultaneously to be cooled, the first high temperature mode may be performed.

On the contrary, when the cooling of the refrigerating chamber and the cooling of freezing chamber are not simultaneously performed, the controller 400*b* may control the second flow path switching valve 210*b* such that the refrigerant flows into the third capillary tube 151*b* (2500).

More specifically, the controller 400*b* may control the second flow path switching valve 210*b* such that the refrigerant having passed through the cluster pipe 140*b* flows into the third capillary tube 151*b*. Thereafter, the refrigerant may flow to the second evaporator 180*b* connected to the third capillary tube 151*b*.

Accordingly, the second high temperature mode is performed (2700).

That is, the second high temperature mode is a mode in which the refrigerant sequentially passes through the compressor 110*b*, the condenser 120*b*, the hot pipe 130*b*, the first flow path switching valve 200*b*, the cluster pipe 140*b*, the third capillary tube 151*b*, and the second evaporator 180*b*. Accordingly, when the ambient temperature is high and only the freezing chamber is desired to be cooled, the second high temperature mode may be performed.

In the above, the operations of the first high-temperature mode and the second high-temperature mode have been described.

Hereinafter, the operations of the first low temperature mode and the second low temperature mode will be described with reference to FIGS. 9A and 9B.

When it is identified that the detected external temperature is not higher than or equal to the set temperature, the controller 400*b* may determine whether to simultaneously perform cooling of the refrigerating chamber and cooling of the freezing chamber (3300).

When it is desired to simultaneously perform cooling of the refrigerating chamber and cooling of the freezing chamber, the controller 400*b* may control the first flow path switching valve 200*b* such that the refrigerant flows into the second capillary tube 160*b* (3400).

More specifically, the controller 400*b* may control the first flow path switching valve 200*b* such that the refrigerant bypasses the cluster pipe 140*b* and flows into the second capillary tube 160*b*. Thereafter, the refrigerant may flow into the first evaporator 170*b* connected to the second capillary tube 160*b*.

Accordingly, the first low temperature mode is performed (3600).

That is, the first low-temperature mode is a mode in which the refrigerant sequentially passes through the compressor 110*b*, the condenser 120*b*, the hot pipe 130*b*, the first flow path switching valve 200*b*, the second capillary tube 160*b*, the first evaporator 170*b*, and the second evaporator 180*b*. Accordingly, when the ambient temperature is low and the freezing chamber and the refrigerating chamber are simultaneously to be cooled, the first low temperature mode may be performed.

Conversely, when cooling of the refrigerating chamber and cooling of the freezing chamber are not simultaneously performed, the controller 400*b* may control the first flow path switching valve 200*b* such that the refrigerant flows into the fourth capillary tube 161*b* (3500).

More specifically, the controller 400*b* may control the first flow path switching valve 200*b* such that the refrigerant bypasses the cluster pipe 140*b* and flows into the fourth capillary tube 161*b*. Thereafter, the refrigerant may flow into the second evaporator 180*b* connected to the fourth capillary tube 161*b*.

Accordingly, the second low temperature mode is performed (3700).

That is, the second low temperature mode is a mode in which the refrigerant sequentially passes through the compressor 110*b*, the condenser 120*b*, the hot pipe 130*b*, the first flow path switching valve 200*b*, the fourth capillary tube 161*b*, and the second evaporator 180*b*. Accordingly, when the ambient temperature is low and only the freezing chamber is desired to be cooled, the second low temperature mode may be performed.

Therefore, the cold air supply device 100*b* of the refrigerator according to the embodiment of the disclosure is provided such that cooling of the freezing chamber and cooling of the refrigerating chamber may be simultaneously performed, or only cooling of the freezing chamber may be performed. To this end, the first evaporator 170*b* and the second evaporator 180*b* are connected in series with each other. In addition, the refrigerant is provided to have a different flow by distinguishing a case when the ambient temperature is higher than or equal to the set temperature and a case when the temperature is lower than the set temperature.

Figure 10:
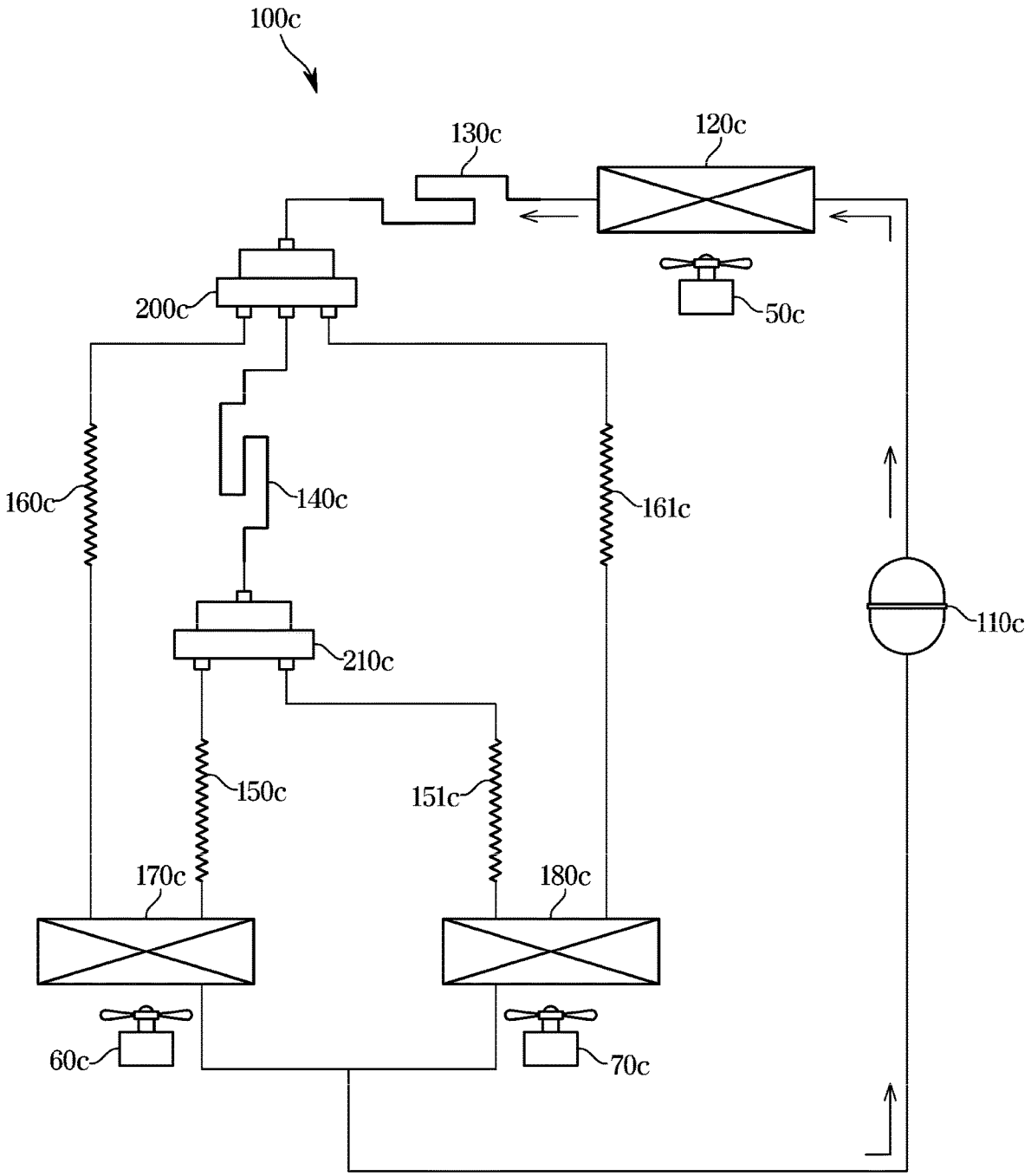
FIG. 10 is a circuit diagram illustrating a cold air supply device of a refrigerator according to still another embodiment of the disclosure.
Figure 11A:
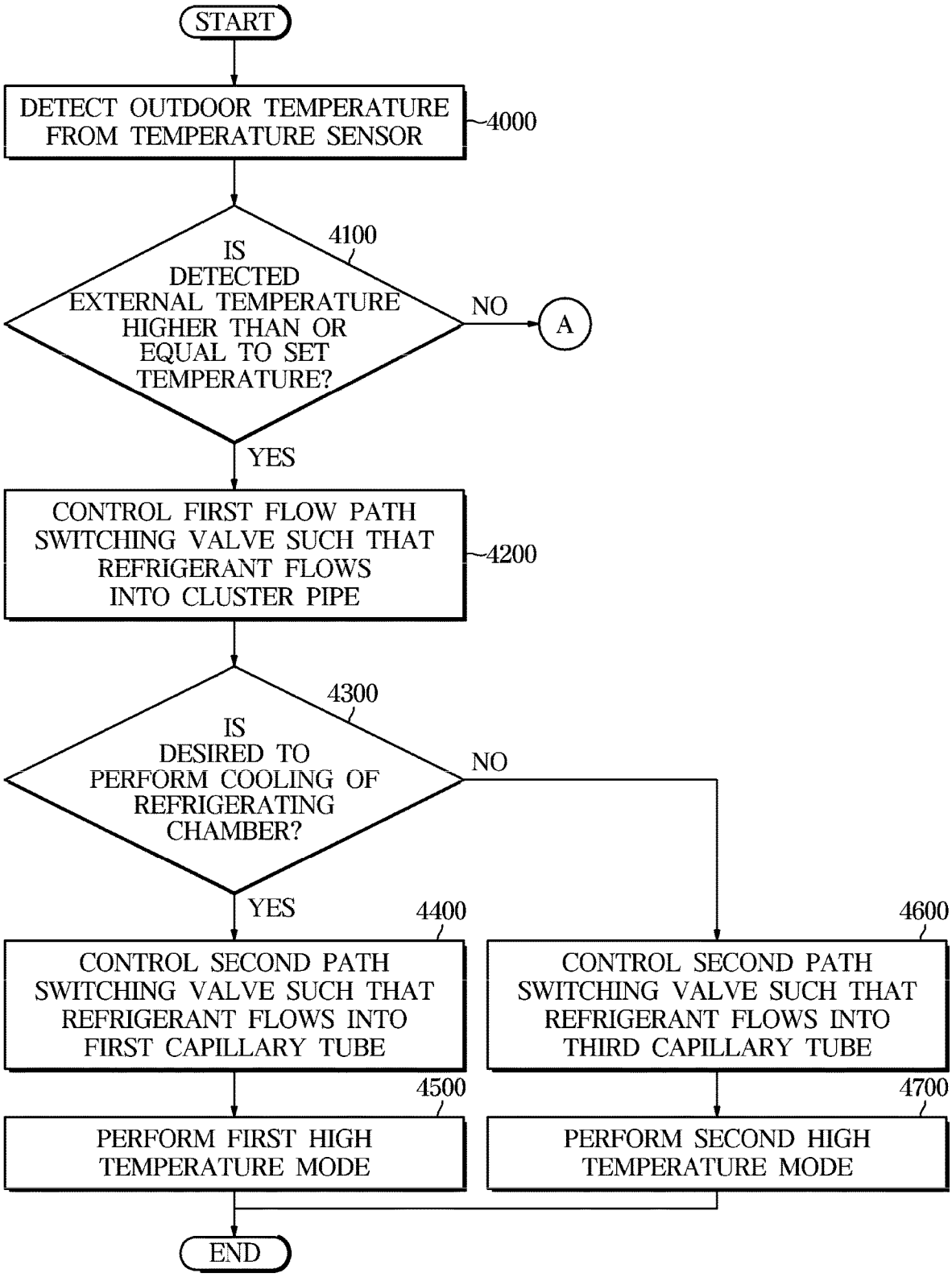
FIGS. 11A and 11B are flowcharts showing a method of controlling the refrigerator according to an embodiment of the disclosure.
Figure 11B:
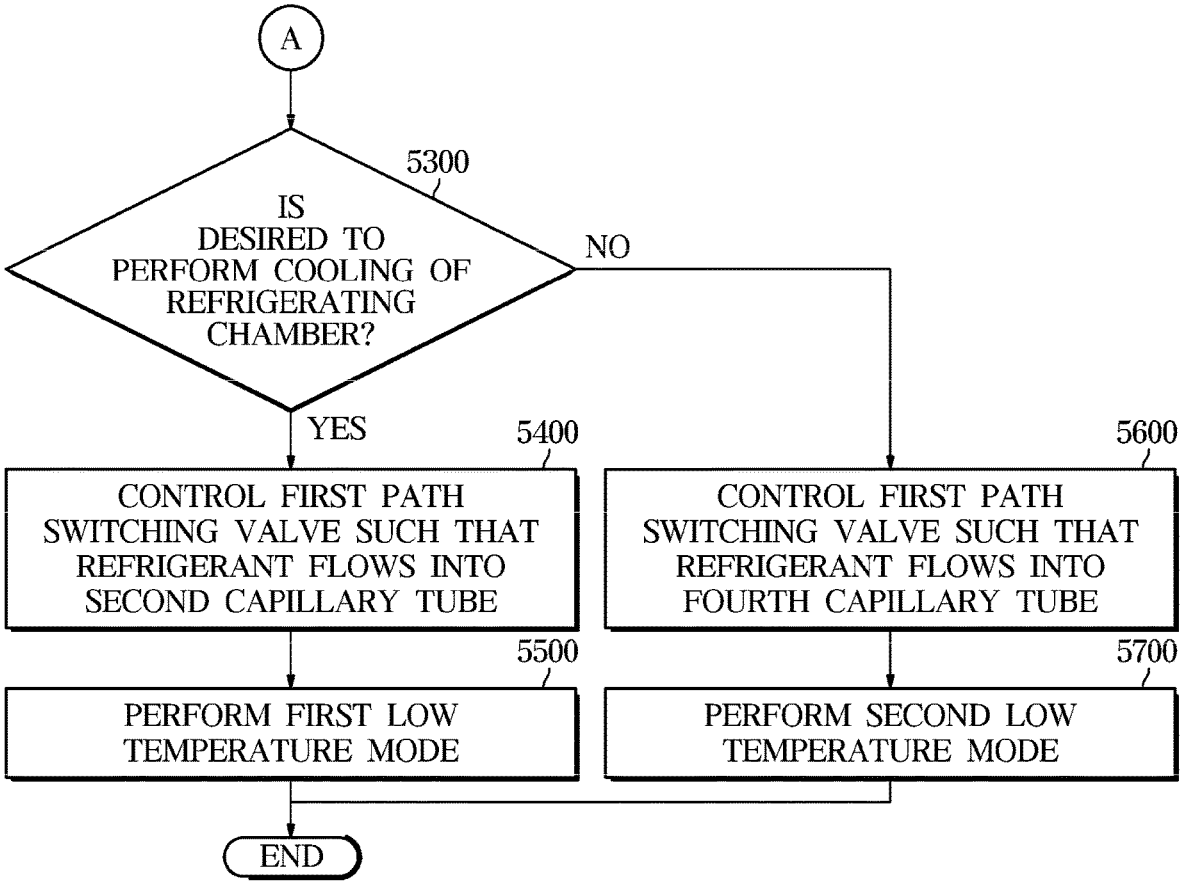

FIG. 10 is a circuit diagram illustrating a cold air supply device of a refrigerator according to still another embodiment of the disclosure. FIGS. 11A and 11B are flowcharts showing a method of controlling the refrigerator according to an embodiment of the disclosure.

Referring to FIG. 10, the refrigerator according to the embodiment of the disclosure may include a cold air supply device 100*c* for supplying cold air into the storage chamber.

Unlike the cold air supply device 100 of the refrigerator according to an embodiment of the disclosure, the cold air supply device 100*c* of the refrigerator according to the embodiment of the disclosure may include a plurality of evaporators. The plurality of evaporators may include a first evaporator 170*c* disposed in the refrigerating chamber and a second evaporator 180*c* disposed in the freezing chamber.

In addition, in the cold air supply device 100*c* of the refrigerator according to the embodiment of the disclosure, the first evaporator 170*c* and the second evaporator 180*c* are connected in parallel with each other such that cooling of the refrigerating chamber and cooling of the freezing chamber are independently cooled. Details thereof will be described with reference to FIG. 10.

The cold air supply device 100*c* of the refrigerator according to the embodiment of the disclosure may include a compressor 110*c* and a condenser 120*c*.

The compressor 110*c* may be provided to compress a refrigerant provided to circulate the cold air supply device 100*c* into a high-temperature and high-pressure gas.

The condenser 120*c* may be provided to condense the refrigerant compressed in the compressor 110*c*. Specifically, the condenser 120*c* may be provided to radiate heat to the high-temperature and high-pressure gas refrigerant compressed in the compressor 110*c* such that the high-temperature and high-pressure gas refrigerant is subject to phase-change into a liquid at a room temperature.

The cold air supply device 100*c* may include a hot pipe 130*c*. The hot pipe 130*c* may be installed at a circumference of the main body of the refrigerator to prevent water vapor from condensing at a portion where the door and the main body of the refrigerator come in contact with each other. The hot pipe 130*c* may be disposed between the condenser 120*c* and a first flow path switching valve 200*c*.

The working refrigerant flowing through the cold air supply device 100*c* may include HC-based isobutane (R600a), propane (R290), HFC-based R134a, and HFO-based R1234yf. However, the type of refrigerant is not limited, and the refrigerant may be provided in any other type as long as it can reach a target temperature through heat exchange with the surroundings.

The cold air supply device 100*c* may include a first flow path switching valve 200*c*, a second flow path switching valve 210*c*, a first capillary tube 150*c*, a second capillary tube 160*c*, a third capillary tube 151*c*, and a fourth capillary tube 161*c*. In addition, the cold air supply device 100*c* may include a cluster pipe 140*c*.

The cluster pipe 140*c*, the second capillary tube 160*c*, and the fourth capillary tube 161*c* may be connected in parallel with each other at the outlet side of the first flow path switching valve 200*c*. The first flow path switching valve 200*c* may be provided such that the refrigerant flows into one of the cluster pipe 140*c*, the second capillary tube 160*c*, and the fourth capillary tube 161*c*.

The second flow path switching valve 210*c* may be disposed at the outlet side of the cluster pipe 140*c*.

The first capillary tube 150*c* and the third capillary tube 151*c* may be connected in parallel with other at the outlet side of the second flow path switching valve 210*c*. Accordingly, the second flow path switching valve 210*c* may be provided such that the refrigerant passing through the cluster pipe 140*c* flows into the first capillary tube 150*c* or the third capillary tube 151*c*.

The first capillary tube 150*c* and the second capillary tube 160*c* may be provided to have different tube diameters and lengths. In addition, the third capillary tube 151*c* and the fourth capillary tube 161*c* may be provided to have different tube diameters and lengths. More specifically, the second capillary tube 160*c* may be provided to have a length longer than that of the first capillary tube 150*c*, and the fourth capillary tube 161*c* may be provided to have a length shorter than that of the third capillary tube 151*c*. In addition, the first capillary tube 150*c* and the third capillary tube 151*c* may be provided to be identical to each other, and the second capillary tube 160*c* and the fourth capillary tube 161*c* may be provided to be identical to each other.

The refrigerant expands while flowing through one of the first capillary tube 150*c* to the fourth capillary tube 161*c*, to be lowered in the pressure.

According to the operation of the first high temperature mode, the second high temperature mode, the first low temperature mode, and the second low temperature mode to be described below, the refrigerant may flow into one of the first capillary tubes 150*c* to the fourth capillary tubes 161*c*. Details thereof will be described below.

The cluster pipe 140*c* may be provided to assist in the condensation of the refrigerant. More specifically, the cluster pipe 140*c* may be provided to additionally radiate a high-temperature refrigerant to serve as the auxiliary condenser 120*c*.

The cluster pipe 140*c* may be disposed between the first flow path switching valve 200*c* and the second flow path switching valve 210*c*. With such a configuration, the refrigerant may pass through the cluster pipe 140*c* only when the first flow path switching valve 200*c* is controlled to be opened toward the second flow path switching valve 210*c*. In other words, when the first flow path switching valve 200*c* is controlled to be opened toward the second capillary tube 160*c* or the fourth capillary tube 161*c*, the refrigerant may not pass through the cluster pipe 140*c*.

The cold air supply device 100*c* may include a plurality of evaporators. The plurality of evaporators may be provided to be connected in parallel with each other at the outlet side of the first capillary tube 150*c* to the fourth capillary tube 161*c* connected in parallel. More specifically, the first evaporator 170*c* is connected to the first capillary tube 150*c* and the second capillary tube 160*c*, and the second evaporator 180*c* is connected to the third capillary tube 151*c* and the fourth capillary tube 161*c*. In addition, the first evaporator 170*c* and the second evaporator 180*c* may be connected in parallel with each other.

The plurality of evaporators are provided to allow the refrigerant, which has been expanded in one of the first capillary tube 150*c* to the fourth capillary tube 161*c* into a low-pressure liquid state, to be subject to phase-change into a gas to absorb surrounding heat. In other words, the evaporator may be provided to evaporate the refrigerant.

The first evaporator 170*c* may be disposed in the refrigerating chamber to supply cold air to the refrigerating chamber.

The second evaporator 180*c* may be disposed in the freezing chamber to supply cold air to the freezing chamber.

The cold air supply device 100*c* may include a heat dissipation fan 50*c* and a plurality of blowing fans.

The heat dissipation fan 50*c* may be provided adjacent to the condenser 120*c*. The plurality of blowing fans may be provided adjacent to the plurality of evaporators. The plurality of blowing fans may include a first blowing fan 60*c* disposed adjacent to the first evaporator 170*c* and a second blowing fan 70*c* disposed adjacent to the second evaporator 180*c*.

The heat dissipation fan 50*c* may be provided to increase the heat dissipation efficiency of the condenser 120*c*. The plurality of blowing fans may be provided to increase the evaporation efficiency of the plurality of evaporators, respectively.

The compressor 110*c*, the condenser 120*c*, the hot pipe 130*c*, the first and second flow path switching valves 200*c* and 210*c*, the first capillary tube 150*c* to the fourth capillary tube 161*c*, and the plurality of evaporators are connected to each other through a connecting pipe so that a closed loop refrigerant circuit in which the refrigerant circulates may be provided in the refrigerator.

The refrigerator according to the embodiment of the disclosure provides various cooling modes under the control of a controller such as a microcomputer. A control block diagram of the refrigerator according to the embodiment of the disclosure may be provided in the same manner as the control block diagram shown in FIG. 8, and may be described in the same manner.

Referring to FIGS. 10 to 11B, the controller controls the first flow path switching valve 200*c* and the second flow path switching valve 210*c* to implement various cooling modes. More specifically, the controller may receive the temperature information detected by the temperature sensor and control the cold air supply device 100*c* to operate in the first high temperature mode, the second high temperature mode, the first low temperature mode, or the second low temperature mode.

Referring to FIGS. 10 to 11B, the refrigerator may detect an external temperature from a temperature sensor (4000).

The controller may receive information about the detected external temperature.

The controller may identify whether the detected external temperature is higher than or equal to a set temperature (4100).

As the measurement standard for power consumption has recently been changed, the power consumption of the refrigerator 1 is measured under conditions when the external temperatures are 32° C. and 16° C. Accordingly, the set temperature may be provided at a temperature between approximately 23 and 25 degrees. However, the range of the set temperature is not limited thereto.

When it is identified that the detected external temperature is higher than or equal to the set temperature, the controller controls the first flow path switching valve 200*c* such that the refrigerant flows into the cluster pipe 140*c* (4200).

In addition, the controller may identify whether to perform cooling on the refrigerating compartment (4300).

When it is desired to perform cooling of the refrigerating chamber, the controller may control the second flow path switching valve 210*c* such that the refrigerant flows into the first capillary tube 150*c* (4400).

More specifically, the controller may control the second flow path switching valve 210*c* such that the refrigerant having passed through the cluster pipe 140*c* flows into the first capillary tube 150*c*. Thereafter, the refrigerant may flow into the first evaporator 170*c* connected to the first capillary tube 150*c*.

Accordingly, the first high temperature mode is performed (4500).

That is, the first high temperature mode is a mode in which the refrigerant sequentially passes through the compressor 110*c*, the condenser 120*c*, the hot pipe 130*c*, the first flow path switching valve 200*c*, the cluster pipe 140*c*, the first capillary tube 150*c*, and the first evaporator 170*c*. Accordingly, when the ambient temperature is high and the refrigerating chamber is desired to be cooled, the first high temperature mode may be performed. In the cold air supply device 100*c* of the refrigerator according to the embodiment of the disclosure, since the first evaporator 170*c* and the second evaporator 180*c* are arranged in parallel, cooling of the refrigerating chamber and cooling of the freezing chamber are performed independently. Accordingly, in the first high temperature mode, cooling of the refrigerating chamber may be performed, but cooling of the freezing chamber may not be performed.

Conversely, when it is identified that cooling of the refrigerating chamber is not performed, the controller may control the second flow path switching valve 210*c* such that the refrigerant flows into the third capillary tube 151*c* (4600).

More specifically, the controller may control the second flow path switching valve 210*c* such that the refrigerant having passed through the cluster pipe 140*c* flows into the third capillary tube 151*c*. Thereafter, the refrigerant may flow into the second evaporator 180*c* connected to the third capillary tube 151*c*.

Accordingly, the second high temperature mode is performed (4700).

That is, the second high temperature mode is a mode in which the refrigerant sequentially passes through the compressor 110*c*, the condenser 120*c*, the hot pipe 130*c*, the first flow path switching valve 200*c*, the cluster pipe 140*c*, the third capillary tube 151*c*, and the second evaporator 180*c*. Accordingly, when the ambient temperature is high and the freezing chamber is desired to be cooled, the second high temperature mode may be performed. In the cold air supply device 100*c* of the refrigerator according to the embodiment of the disclosure, since the first evaporator 170*c* and the second evaporator 180*c* are arranged in parallel, cooling of the refrigerating chamber and cooling of the freezing chamber are performed independently. Accordingly, in the second high temperature mode, cooling of the freezing chamber may be performed, but cooling of the refrigerating chamber may not be performed.

In the above, the operations of the first high-temperature mode and the second high-temperature mode have been described.

Hereinafter, the operations of the first low temperature mode and the second low temperature mode will be described with reference to FIGS. 11A and 11B.

When it is identified that the detected external temperature is not higher than or equal to the set temperature, the controller may identify whether to perform cooling of the refrigerating chamber (5300).

When it is desired to perform cooling of the refrigerating chamber, the controller may control the first flow path switching valve 200*c* such that the refrigerant flows into the second capillary tube 160*c* (5400).

More specifically, the controller may control the first flow path switching valve 200*c* such that the refrigerant bypasses the cluster pipe 140*c* and flows into the second capillary tube 160*c*. Thereafter, the refrigerant may flow into the first evaporator 170*c* connected to the second capillary tube 160*c*.

Accordingly, the first low temperature mode is performed (5500).

That is, the first low temperature mode is a mode in which the refrigerant sequentially passes through the compressor 110*c*, the condenser 120*c*, the hot pipe 130*c*, the first flow path switching valve 200*c*, the second capillary tube 160*c*, and the first evaporator 170*c*. Accordingly, when the ambient temperature is low and the refrigerating chamber is desired to be cooled, the first low temperature mode may be performed. In the cold air supply device 100*c* of the refrigerator according to the embodiment of the disclosure, since the first evaporator 170*c* and the second evaporator 180*c* are arranged in parallel, cooling of the refrigerating chamber and cooling of the freezing chamber are performed independently. Accordingly, in the first low temperature mode, cooling of the refrigerating chamber may be performed, but cooling of the freezing chamber may not be performed.

Conversely, when it is identified that cooling of the refrigerating chamber is not performed, the controller may control the first flow path switching valve 200*c* such that the refrigerant flows into the fourth capillary tube 161*c* (5600).

More specifically, the controller may control the first flow path switching valve 200*c* such that the refrigerant bypasses the cluster pipe 140*c* and flows to the fourth capillary tube 161*c*. Thereafter, the refrigerant may flow into the second evaporator 180*c* connected to the fourth capillary tube 161*c*.

Accordingly, the second low temperature mode is performed (5700).

That is, the second low temperature mode is a mode in which the refrigerant sequentially passes through the compressor 110*c*, the condenser 120*c*, the hot pipe 130*c*, the first flow path switching valve 200*c*, the fourth capillary tube 161*c*, and the second evaporator 180*c*. Accordingly, when the ambient temperature is low and the freezing chamber is desired to be cooled, the second low temperature mode may be performed. In the cold air supply device 100*c* of the refrigerator according to the embodiment of the disclosure, since the first evaporator 170*c* and the second evaporator 180*c* are arranged in parallel, cooling of the refrigerating chamber and cooling of the freezing chamber are performed independently. Accordingly, in the second low temperature mode, cooling of the freezing chamber may be performed, but cooling of the refrigerating chamber may not be performed.

Therefore, in the cold air supply device 100*c* of the refrigerator according to the embodiment of the disclosure, cooling of the freezing chamber and cooling of the refrigerating chamber are independently performed. To this end, the first evaporator 170*c* and the second evaporator 180*c* are connected in parallel. In addition, the refrigerant is provided to have a different flow by distinguishing a case when the ambient temperature is higher than or equal to the set temperature and a case when the temperature is lower than the set temperature.

Although few embodiments of the disclosure have been shown and described, the above embodiment is illustrative purpose only, and it would be appreciated by those skilled in the art that changes and modifications may be made in these embodiments without departing from the principles and scope of the disclosure, the scope of which is defined in the claims and their equivalents.

What is claimed is:

1. A refrigerator comprising:

a main body having a storage chamber; and a cold air supply device configured to supply cold air to the storage chamber, wherein the cold air supply device comprises:

a compressor;

a condenser configured to condense a refrigerant compressed by the compressor;

a first flow path switching valve connected to the condenser;

a second flow path switching valve connected to the first flow path switching valve;

a cluster pipe connected to the first flow path switching valve and the second flow path switching valve, respectively, to further condensate the refrigerant pass therethrough;

a first capillary tube connected to the second flow path switching valve;

a second capillary tube connected to the first flow path switching valve;

a third capillary tube connected to the second flow path switching valve, the third capillary tube arranged in parallel with the first capillary tube; and wherein the first flow path switching valve is configured to selectively allow the refrigerant received from the condenser to flow into the cluster pipe or the second capillary tube, and the second flow path switching valve is configured to selectively allow the refrigerant received from the cluster pipe to flow into the first capillary tube or the third capillary tube.

2. The refrigerator of claim 1, further comprising:

a temperature sensor configured to detect an external temperature which is an indoor temperature outside the refrigerator; and a controller configured to control the cold air supply device based on the external temperature detected by the temperature sensor so that the controller controls the first flow path switching valve to selectively allow the refrigerant received from the condenser to flow into the cluster pipe or the second capillary tube.

3. The refrigerator of claim 2, wherein in response to determining that the detected external temperature is higher than or equal to a set temperature, the controller is configured to control the cold air supply device to operate in a high temperature mode in which the refrigerant received from the condenser flows through the cluster pipe; and in response to determining that the detected external temperature is lower than the set temperature, the controller is configured to control the cold air supply device to operate in a low temperature mode in which the refrigerant received from the condenser bypasses the cluster pipe, and flows through the second capillary tube.

4. The refrigerator of claim 3, wherein the cold air supply device further comprises a heat dissipation fan configured to increase a heat dissipation efficiency of the condenser, and wherein the controller, in the low temperature mode, controls the heat dissipation fan to be driven at a revolutions per minute (RPM) lower than a RPM in the high temperature mode.

5. The refrigerator of claim 1, wherein the cold air supply device further comprises an evaporator connected to the first capillary tube and to the second capillary tube to evaporate the refrigerant received from the first capillary tube or the second capillary tube.

6. The refrigerator of claim 5, wherein the storage chamber includes a refrigerating chamber and a freezing chamber, and the evaporator includes a first evaporator disposed in the refrigerating chamber and a second evaporator disposed in the freezing chamber.

7. The refrigerator of claim 6, wherein the first capillary tube and the second capillary tube are connected to the first evaporator, and the third capillary tube is connected to the second evaporator.

8. The refrigerator of claim 7, wherein the cold air supply device further comprises a fourth capillary tube connected to the first flow path switching valve and in parallel with the second capillary tube and the cluster pipe so that the refrigerant received from the condenser is selectively flows into the second capillary tube, the cluster pipe or the fourth capillary tube, and the second capillary tube is connected to the first evaporator, and the fourth capillary tube is connected to the second evaporator.

9. The refrigerator of claim 8, further comprising:

a temperature sensor configured to detect an external temperature which is an indoor temperature outside the refrigerator; and a controller configured to control the first flow path switching valve and the second flow path switching valve based on the external temperature detected by the temperature sensor to selectively allow the refrigerant received from the condenser to flow into the first capillary tube, the second capillary tube, third capillary tube, or the fourth capillary tube.

10. The refrigerator of claim 9, wherein in response to determining that the detected external temperature is higher than or equal to a first high set temperature, the controller controls the cold air supply device to operate in a first high temperature mode in which the refrigerant flows through the cluster pipe and then flows through the first capillary tube and the first evaporator, and wherein in response to determining that the detected external temperature is higher than or equal to a second high set temperature, the controller controls the cold air supply device to operate in a second high temperature mode in which the refrigerant passes through the cluster pipe and then flows through the third capillary tube and the second evaporator.

11. The refrigerator of claim 10, wherein in response to determining that the detected external temperature is lower than a first low set temperature, the controller controls the cold air supply device to operate in a first low temperature mode in which the refrigerant bypasses the cluster pipe and flows through the second capillary tube and the first evaporator, and wherein in response to determining that the detected external temperature is lower than a second low set temperature, the controller controls the cold air supply device to operate in a second low temperature mode in which the refrigerant bypasses the cluster pipe and flows through the fourth capillary tube and the second evaporator.

12. The refrigerator of claim 11, wherein the first evaporator and the second evaporator are connected in series to each other such that cooling of the refrigerating chamber is selectively performed.

13. The refrigerator of claim 11, wherein the first evaporator and the second evaporator are connected in parallel with each other such that cooling of the freezing chamber and cooling of the refrigerating chamber are independently performed.

14. The refrigerator of claim 8, wherein the second capillary tube has a length longer than a length of the first capillary tube, and the fourth capillary tube has a length longer than a length of the third capillary tube.

15. The refrigerator of claim 1, wherein the second capillary tube has a length longer than a length of the first capillary tube.

16. The refrigerator of claim 1, further comprising a hot pipe arranged between the condenser and the flow path switching valve.

17. The refrigerator of claim 1, further comprising a hot pipe arranged between the condenser and the second flow path switching valve.

18. A method of controlling a refrigerator having a condenser, a first flow path switching valve connected to the condenser, a second flow path switching valve connected to the first flow path switching valve, a cluster pipe connected to the first flow path switching valve and the second flow path switching valve, respectively, a first capillary tube connected to the second flow path switching valve, a second capillary tube connected to the first flow path switching valve, a third capillary tube connected to the second flow path switching valve, a temperature sensor, and a controller, the method including:

detecting an external temperature which is an indoor temperature outside the refrigerator by a temperature sensor of the refrigerator;

determining whether the detected external temperature is higher than or equal to a set temperature;

in response to the determining that the detected external temperature is higher than or equal to the set temperature, performing a high temperature mode including:

controlling, by the controller, the first flow path switching valve to allow the refrigerant received from the condenser to pass through the cluster pipe while bypassing the second capillary tube; and controlling the second flow path switching valve to selectively allow the refrigerant passed through the cluster pipe to flow into the first capillary tube or the third capillary tube; and in response to determining the detected external temperature is lower than the set temperature, performing a low temperature mode including:

controlling, by the controller, the first flow path switching valve to allow the refrigerant received from the condenser to pass through the second capillary tube while bypassing the cluster pipe, the first capillary tube and the third capillary tube.

* * * * *